US006899474B2

(12) United States Patent
Uchida et al.

(10) Patent No.: US 6,899,474 B2
(45) Date of Patent: May 31, 2005

(54) RECORDING APPARATUS

(75) Inventors: Kota Uchida, Kanagawa (JP); Haruo Uchida, Kanagawa (JP); Yasuhiko Ikeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/614,005

(22) Filed: Jul. 8, 2003

(65) Prior Publication Data

US 2004/0062587 A1 Apr. 1, 2004

(30) Foreign Application Priority Data

Jul. 10, 2002 (JP) ..... 2002-201036

(51) Int. Cl.[7] ..... B41J 25/308
(52) U.S. Cl. ..... 400/27; 347/8
(58) Field of Search ..... 347/8; 400/27, 400/28

(56) References Cited

U.S. PATENT DOCUMENTS

| | | | | |
|---|---|---|---|---|
| 5,000,590 A | | 3/1991 | Einem | 400/55 |
| 5,135,316 A | | 8/1992 | Kuramitsu et al. | 400/57 |
| 5,692,842 A | | 12/1997 | Sasai et al. | 400/59 |
| 5,721,581 A | | 2/1998 | Saito et al. | 347/249 |
| 6,293,669 B1 | | 9/2001 | Uchida | 347/104 |
| 6,386,663 B1 | | 5/2002 | Olson | 347/8 |
| 6,450,612 B2 | * | 9/2002 | Igarashi et al. | 347/37 |
| 2001/0021330 A1 | | 9/2001 | Kishida et al. | 400/55 |
| 2002/0024574 A1 | | 2/2002 | Uchida | 347/104 |

FOREIGN PATENT DOCUMENTS

| | | | | |
|---|---|---|---|---|
| GB | 2 299 788 A | | 10/1996 | |
| JP | 05092638 A | * | 4/1993 | B41J/25/308 |
| JP | 06135088 A | * | 5/1994 | B41J/25/308 |
| JP | 07040533 A | * | 2/1995 | B41J/2/01 |
| JP | 11-138942 | | 5/1999 | |
| JP | 2002172830 A | * | 6/2002 | B41J/25/308 |

OTHER PUBLICATIONS

Machine translation of JP 6–135088 to Hirano et al. from Japanese Patent Office website.*

* cited by examiner

*Primary Examiner*—Daniel J. Colilla
(74) *Attorney, Agent, or Firm*—Fitzpatrick, Cella, Harper & Scinto

(57) ABSTRACT

To provide a recording apparatus for recording on a sheet by a recording head, including: a carriage for carrying the recording head and moving in a direction crossing a sheet transporting direction; a guide shaft for guiding a movement of the carriage; and a guide shaft lifting mechanism for changing a position in height of the guide shaft at three or more stages without changing a position of the guide shaft in the sheet transporting direction.

6 Claims, 31 Drawing Sheets

RECORDING APPARATUS

BACKGROUND OF THE INVENTION

1. Field of the Invention

The present invention relates to a recording apparatus of a printing apparatus, an image forming apparatus, or the like. In particular, the invention relates to a recording apparatus capable of recording on recording materials having different thicknesses while setting a gap between recording means such as a recording head and the recording material as an appropriate value.

2. Related Background Art

Up to now, various recording materials have been proposed, on which the recording apparatus of the printing apparatus, the image forming apparatus, etc. performs recording. The above recording materials include compact recording materials with a large thickness, such as a CD-R, a DVD, and a card (hereinafter, collectively referred to as compact disc or CD). In the existing general-purpose recording apparatuses, assuming that a transport path for cut paper is adapted for recording on the recording material such as CD, the following defects are caused due to high rigidity of the CD. That is, a transport property is lowered, any scratch develops, or transport cannot be made due to problems concerning a distance between transport rollers. Accordingly, when the compact recording material with the large thickness, such as CD is transported, such an attempt that a tray is used to transport the material through a path different from the transport path for the cut paper has been made.

The tray has a larger thickness than the general cut paper. Thus, the provision of the tray requires sufficient consideration for operations of inserting the recording material into a transport roller pair, nipping it by the transport roller pair, and securing an appropriate gap between the recording head and the recording material. As a measure therefor, a method can be cited in which an operation lever is provided in the recording apparatus to release depression of a transport member in conjunction with an operation of the operation lever. According to this method, the user inserts the tray up to a predetermined position for alignment and then, the lever is operated to set the transport member in a depression state again.

FIGS. 32A, 32B, and 32C are explanatory views showing an eccentric cam 524 and a guide shaft 52 in conventional cases. Further, another attempt has been also made in which a carriage having the recording head mounted thereon is lifted through the operation of the operation lever to thereby secure the appropriate gap between the recording head and the recording material. In this case, as shown in FIG. 31, the eccentric cams 524 are provided at both ends of the guide shaft 52 for scanning the carriage and the eccentric cam operates in conjunction with the operation lever. Also, as for the positional detection of the recording material such as CD (compact disc), recording is started without any positional detection or recording is performed after the sensor mounted on the carriage directly detects a white portion position in the recording range on the CD.

However, the conventional ones devised for securing an appropriate gap between the recording head and the recording material involve the following technical problems.

(a) As shown in FIGS. 32A and 32C, the eccentric cams 524 at both ends of the guide shaft 52 are rotated to lift or lower the guide shaft vertically by the operation lever. At this time, when the print height is changed to two levels, i.e., general print height of the carriage and uppermost print height thereof, the position of the guide shaft 52 in the recording material transporting direction, that is, the position of the carriage in the recording material transporting direction is not changed. However, as shown in FIG. 32B, the print height is changed to intermediate print height, the position of the carriage in the recording material transporting direction is changed. As a result, a recording start position to the recording material should be changed for accurate recording, which leads to a complicated control.

(b) The guide shaft 52 is supported to a main body chassis through the eccentric cams 524 at both ends. Thus, parallelism of the transport roller for transporting the recording material and the guide shaft which are similarly supported to the main body chassis is lowered to some extent corresponding to an involved part tolerance in the case of supporting the guide shaft through the eccentric cams as compared with the case where the guide shaft is directly fixed to the main body chassis. Accordingly, perpendicularity between a carriage scanning direction regulated by the guide shaft and the recording material transporting direction regulated by a transport roller shaft is decreased. This may result in the deteriorated recording quality.

(c) The user operates the lever to thereby select the gap between the recording material and the recording head (gap with a sheet, hereinafter also referred to as sheet gap). As a result, any erroneous lever operation of the user makes a gap value inappropriate, which may cause such defects that the recording quality is deteriorated and the recording material contacts the recording head to stain the recording material.

(d) The position in height of the guide shaft is detected by detecting the rotation position of the eccentric cams by the sensor or the like. As a result, the costs for the sensor etc. increase.

(e) At the time of finely adjusting the general print height by an inter-sheet gap adjustment plate etc., the fine adjustment is made in a state in which the guide shaft is supported through the cams. As a result, when the cams undergo the change with time, the gap with the recording material is changed. This may result in the deteriorated recording quality, in particular, at the general print height, for which high image quality is most highly required.

(f) The structure has not been realized yet, in which the fine adjustment on the general print height is made by use of the inter-sheet gap adjustment plate. In addition, the position in height of the guide shaft is changed at three or more stages without changing the position of the guide shaft in the recording material transporting direction.

SUMMARY OF THE INVENTION

The present invention has been made in view of the above-mentioned problems and it is an object of the present invention to provide a recording apparatus capable of lifting a guide shaft to three or more positions in height inclusive of, for example, general print height, cardboard print height, and CD print height, without changing a position of the guide shaft in a recording material transporting direction. According to the recording apparatus, even when control for changing a recording start position to the recording material such as a CD or a sheet material is omitted, recording can be readily performed at an accurate position on the recording material with a high quality.

Another object of the present invention is to provide a recording apparatus including guide shaft lifting and lowering means, in which an operation for lifting and lowering a guide shaft to plural positions in height without changing a position of the guide shaft in a recording material transporting direction can be achieved with a low-cost structure, without using a position detection sensor or the like.

Still another object of the present invention is to provide a recording apparatus including guide shaft lifting and lowering means capable of: setting a variation from an initial position in height of a guide shaft to each printing position in height as an accurate value with no error even if fine adjustment is made on the initial position in height by a gap adjustment member; securing an appropriate gap with the recording material at any printing position in height of the guide shaft; increasing a recording quality; and changing the guide shaft to three or more positions in height without changing a position of the guide shaft in a recording material transporting direction.

According to the present invention, a recording apparatus for recording on a recording material by recording means, includes: a carriage having the recording means mounted thereon and moving in a direction crossing a recording material transporting direction; a guide shaft for guiding a movement of the carriage; and guide shaft lifting and lowering means for changing a position in height of the guide shaft at three or more stages without changing a position of the guide shaft in the recording material transporting direction.

Also, according to the present invention, a recording apparatus for recording on a recording material by recording means, includes: a carriage having the recording means mounted thereon and moving in a direction crossing a recording material transporting direction; a guide shaft for guiding a movement of the carriage; and guide shaft lifting and lowering means for changing a position in height of the guide shaft at three or more stages, wherein the carriage regulates a state of the guide shaft lifting and lowering means to thereby regulate the position in height of the guide shaft.

Also, according to the present invention, a recording apparatus for recording on a recording material by recording means, includes: a carriage having the recording means mounted thereon and moving in a direction crossing a recording material transporting direction; a guide shaft for guiding a movement of the carriage; a gap adjustment member which is adapted to regulate a position in height of the guide shaft and is capable of adjusting an initial position in height of the guide shaft; and guide shaft lifting and lowering means for changing the position in height of the guide shaft at three or more stages without changing a position of the guide shaft in the recording material transporting direction, wherein the guide shaft lifting and lowering means controls a variation from the initial position in height regulated by the gap adjustment member to thereby change the position in height of the guide shaft.

According to the present invention, a recording apparatus for recording on a recording material by recording means, includes: a carriage having the recording means mounted thereon and moving in a direction crossing a recording material transporting direction; a guide shaft for guiding a movement of the carriage; and guide shaft lifting and lowering means for changing a position in height of the guide shaft at three or more stages without changing a position of the guide shaft in the recording material transporting direction. Consequently, a recording apparatus can be provided, in which the guide shaft can be lifted and lowered to the three or more positions in height without changing the position of the guide shaft in the recording material transporting direction, so that the high-quality recording at the accurate position on the recording material can be readily performed even if the control for changing a recording start position to the recording material is omitted.

Also, according to the present invention, a recording apparatus for recording on a recording material by recording means, includes: a carriage having the recording means mounted thereon and moving in a direction crossing a recording material transporting direction; a guide shaft for guiding a movement of the carriage; and guide shaft lifting and lowering means for changing a position in height of the guide shaft at three or more stages, in which the carriage regulates a state of the guide shaft lifting and lowering means to thereby regulate at least one position in height of the guide shaft. Consequently, a recording apparatus including the guide shaft lifting and lowering means can be provided, with which an operation for lifting and lowering the guide shaft to the plural positions in height without changing the position of the guide shaft in the recording material transporting direction can be achieved without using a position detection sensor etc., with a low-cost structure.

Also, according to the present invention, a recording apparatus for recording on a recording material by recording means, includes: a carriage having the recording means mounted thereon and moving in a direction crossing a recording material transporting direction; a guide shaft for guiding a movement of the carriage; a gap adjustment member which is adapted to regulate a position in height of the guide shaft and is capable of adjusting an initial position in height of the guide shaft; and guide shaft lifting and lowering means for changing the position in height of the guide shaft at three or more stages without changing the position of the guide shaft in the recording material transporting direction, in which the guide shaft lifting and lowering means controls a variation from the initial position in height regulated by the gap adjustment member to thereby change the position in height of the guide shaft. Consequently, a recording apparatus including the guide shaft lifting and lowering means can be provided, with which even if the gap adjustment member makes the fine adjustment on the initial position in height of the guide shaft, the variation from the initial position in height to each of the printing positions in height can be set as an accurate value with no error; whichever printing position in height the guide shaft is located at, the appropriate gap with the recording material can be secured; the recording quality can be improved; and the position of the guide shaft can be changed to the three or more positions in height without changing the position of the guide shaft in the recording material transporting direction.

DETAILED DESCRIPTION OF THE PREFERRED EMBODIMENTS

Hereinafter, a specific description will be given of embodiments of the present invention with reference to the accompanying drawings. Throughout the drawings, identical or corresponding components are denoted by the same symbols.

(Embodiment 1)

Figure 1:
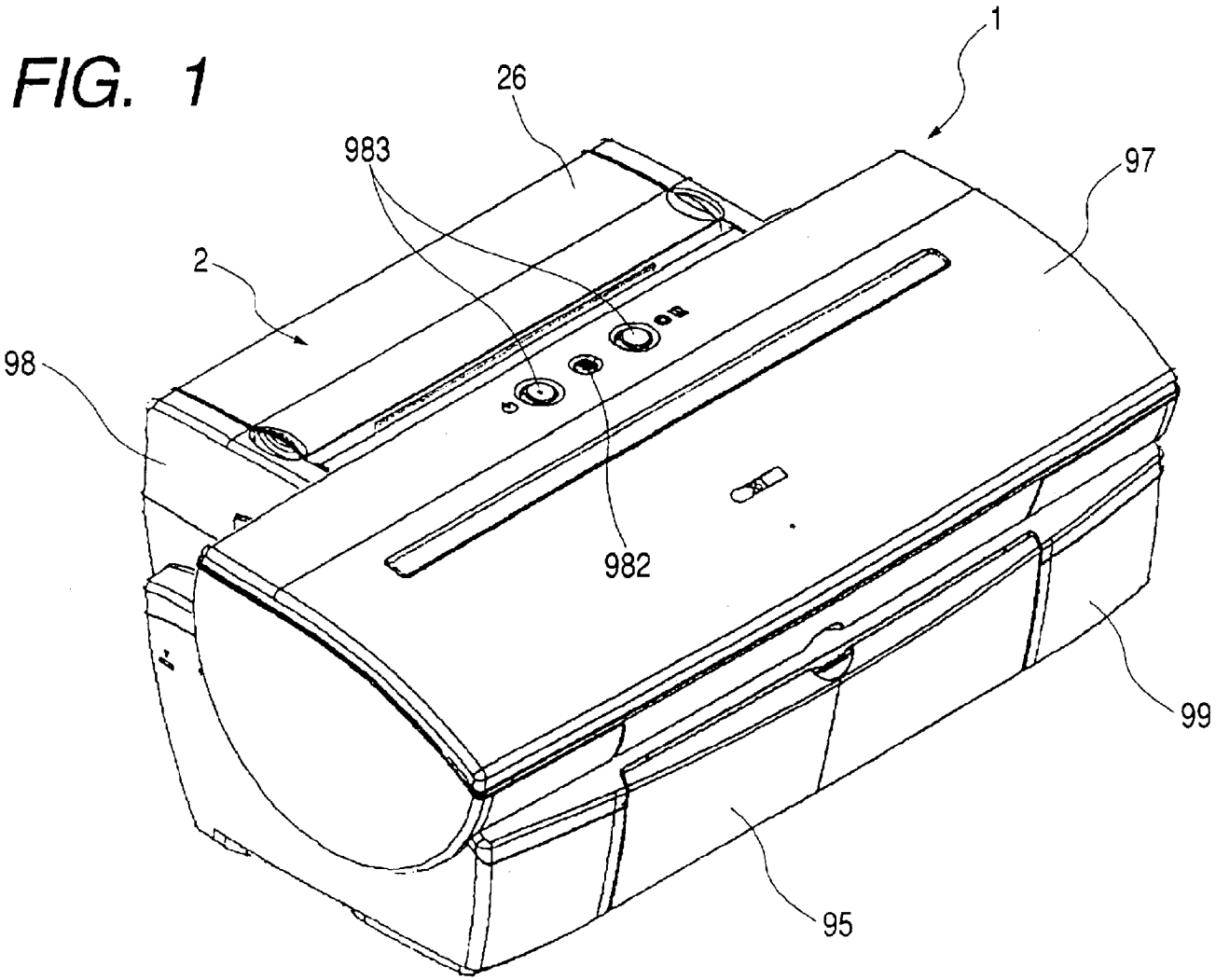
FIG. 1 is a perspective view showing an embodiment of a recording apparatus to which the present invention is applied.
Figure 2:
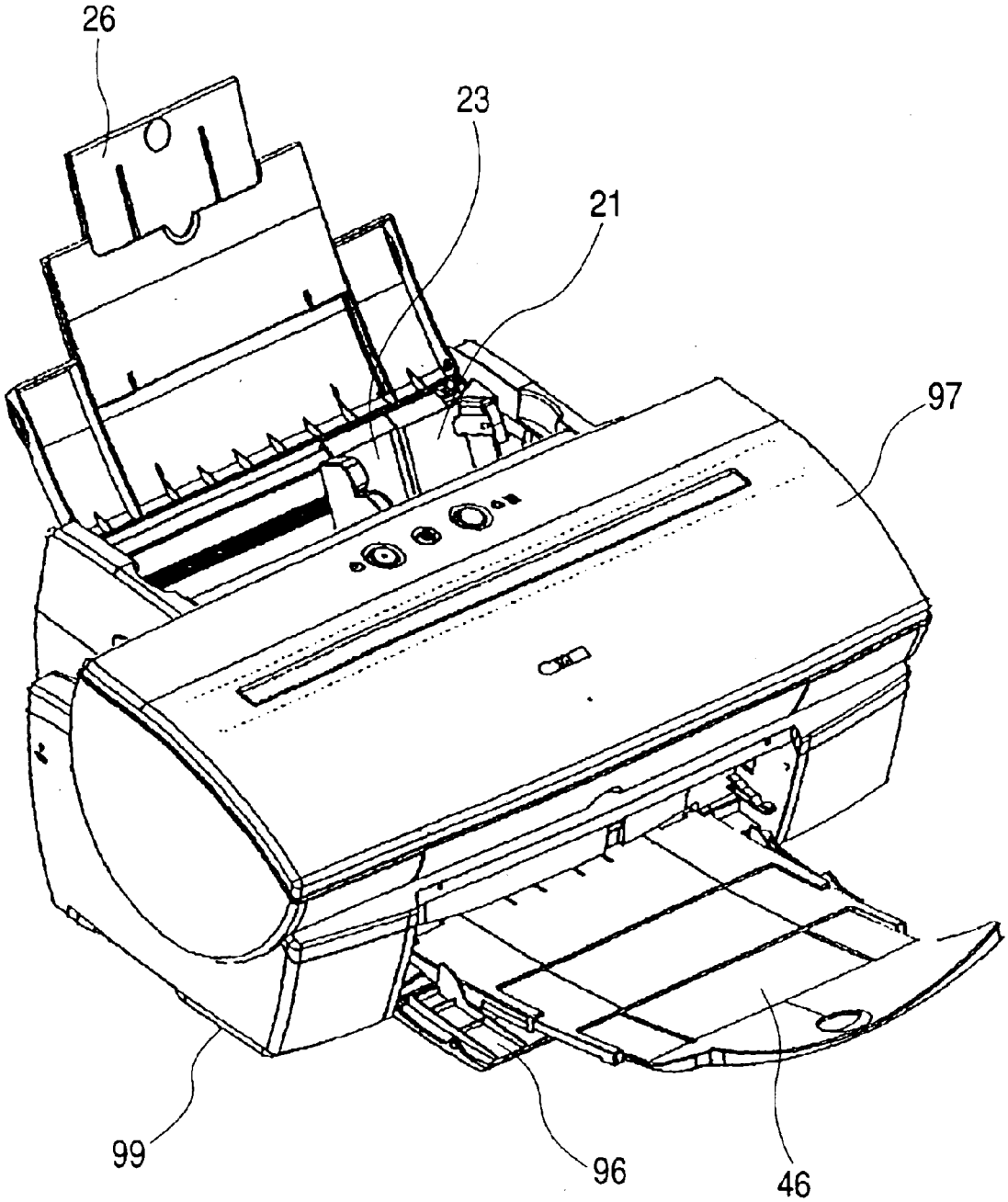
FIG. 2 is a perspective view showing the recording apparatus of FIG. 1 with a sheet feeding tray and a sheet delivery tray opened.
Figure 3:
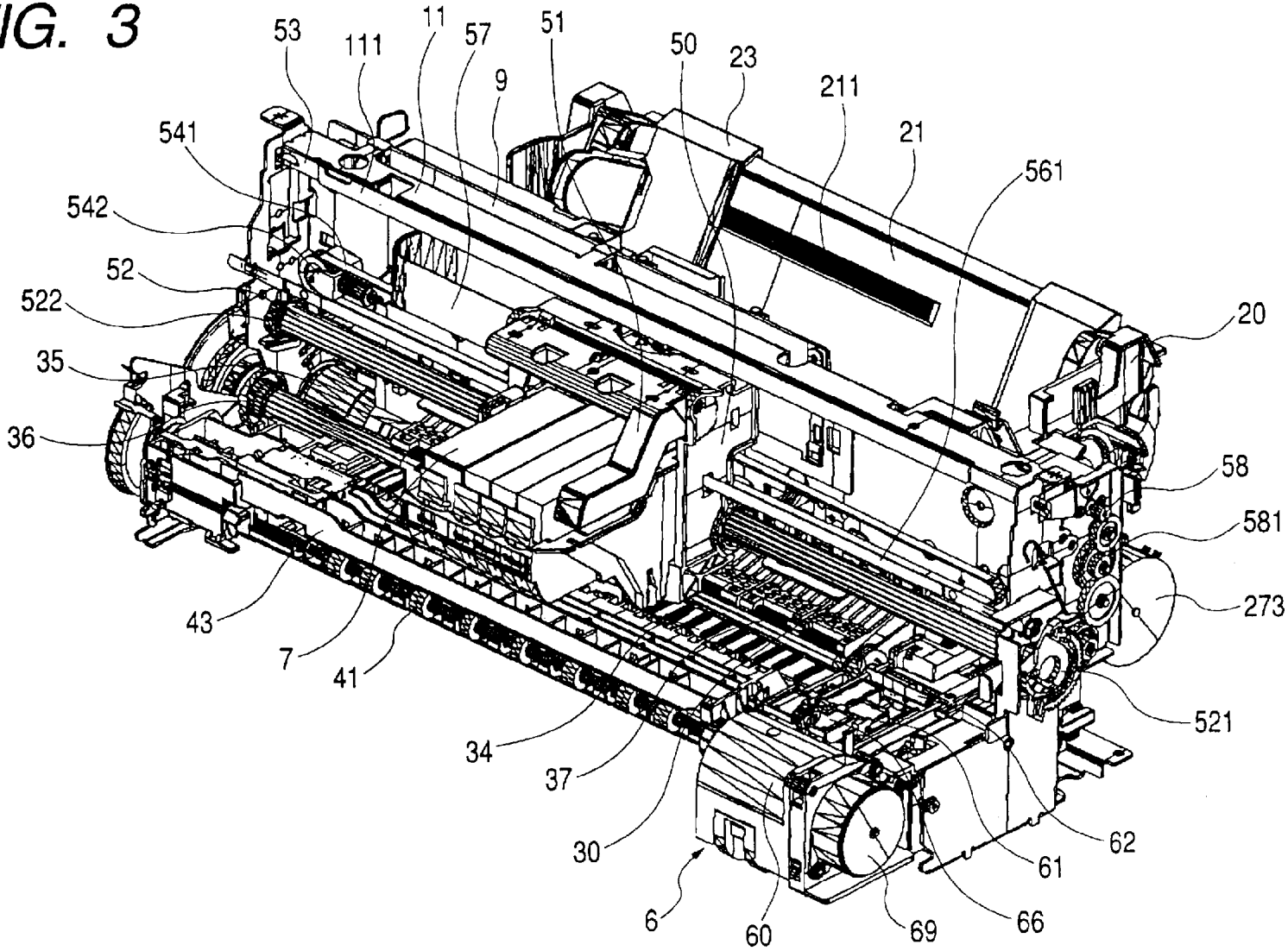
FIG. 3 is a perspective view showing an internal mechanism of the recording apparatus of FIG. 1 as viewed from a right-hand front side.
Figure 4:
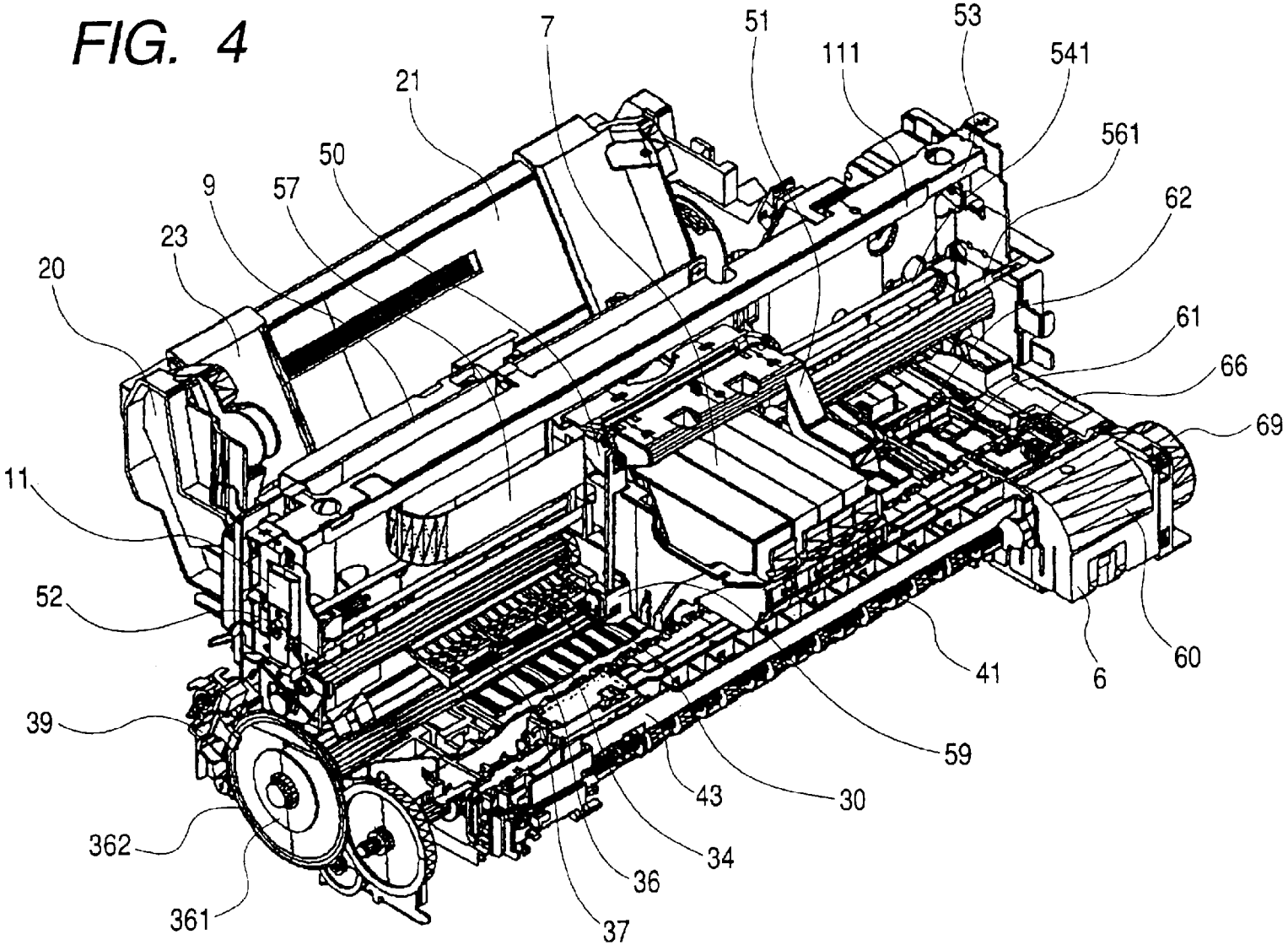
FIG. 4 is a perspective view showing an internal mechanism of the recording apparatus of FIG. 3 as viewed from a left-hand front side.
Figure 5:
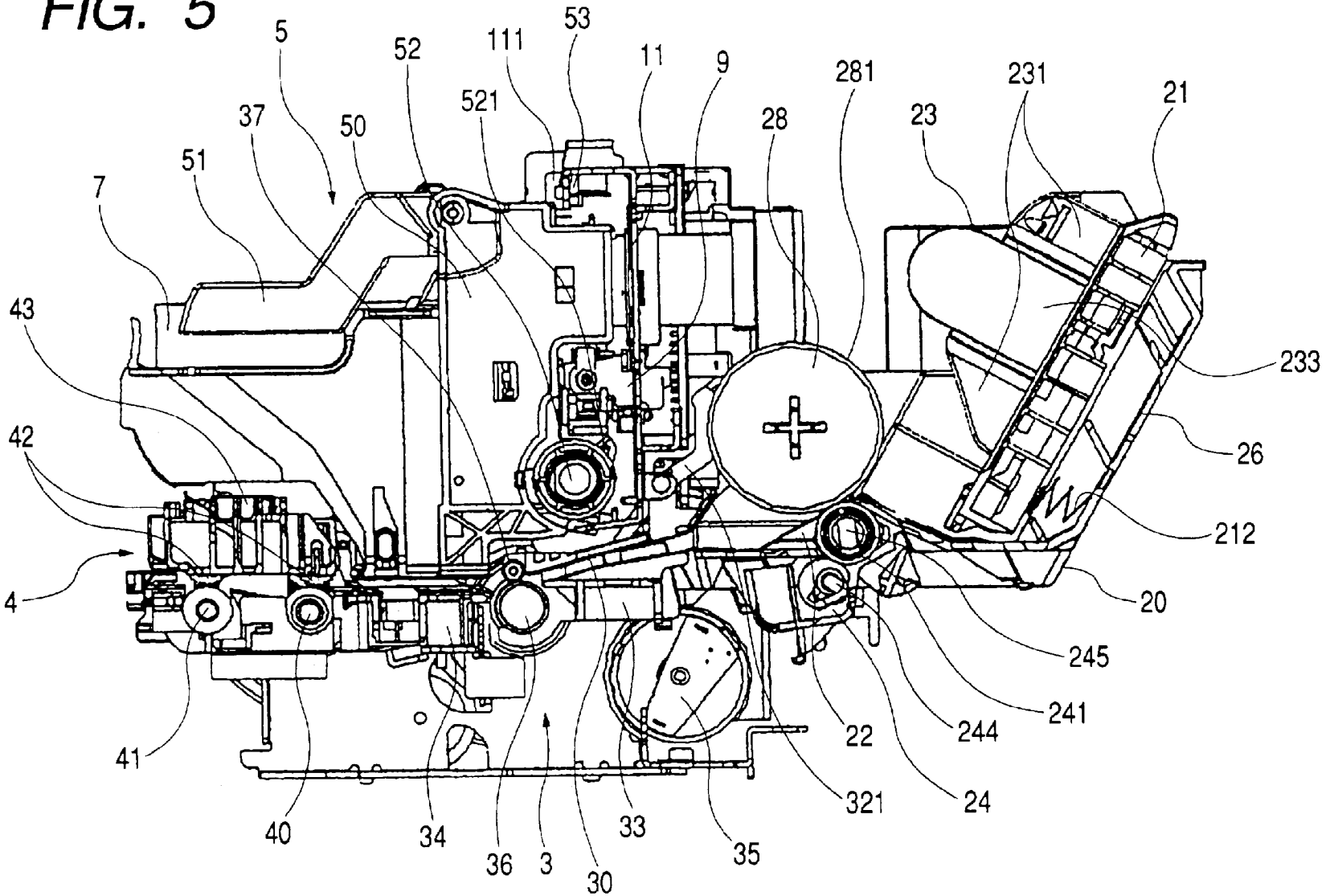
FIG. 5 is a longitudinal sectional view showing the recording apparatus of FIG. 3.
Figure 6A:
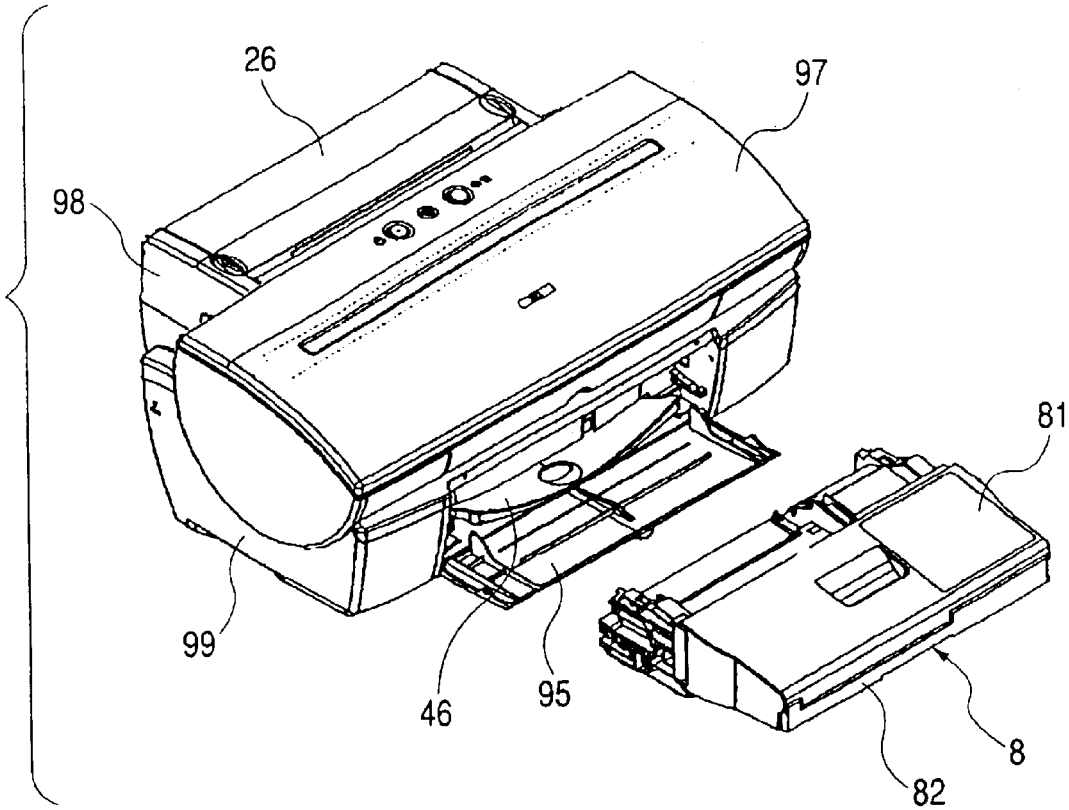
FIG. 6A is a perspective view showing the state before a CD transporting unit is attached to the recording apparatus of FIG. 1.
Figure 6B:
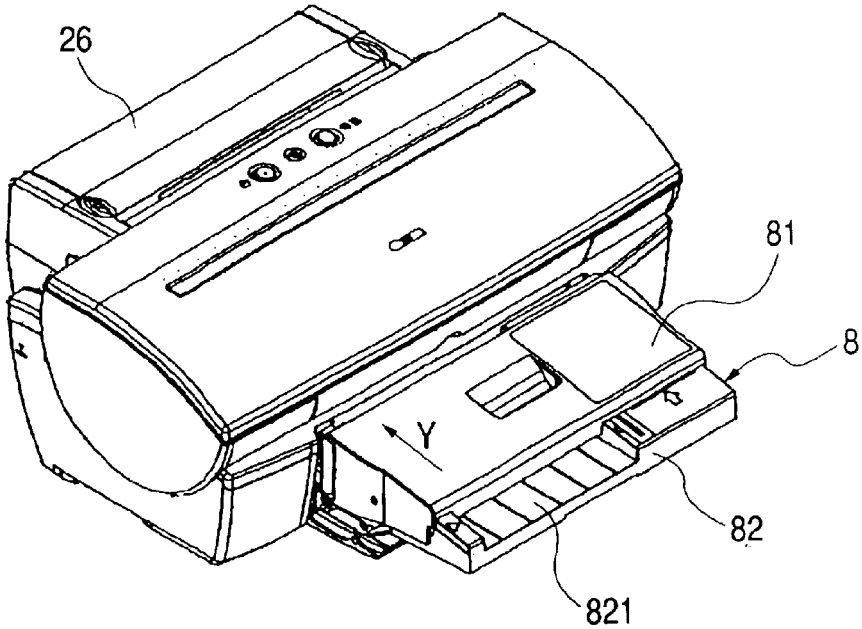
FIG. 6B is a perspective view showing the state in which the CD transporting unit is attached to the recording apparatus of FIG. 1.
Figure 7:
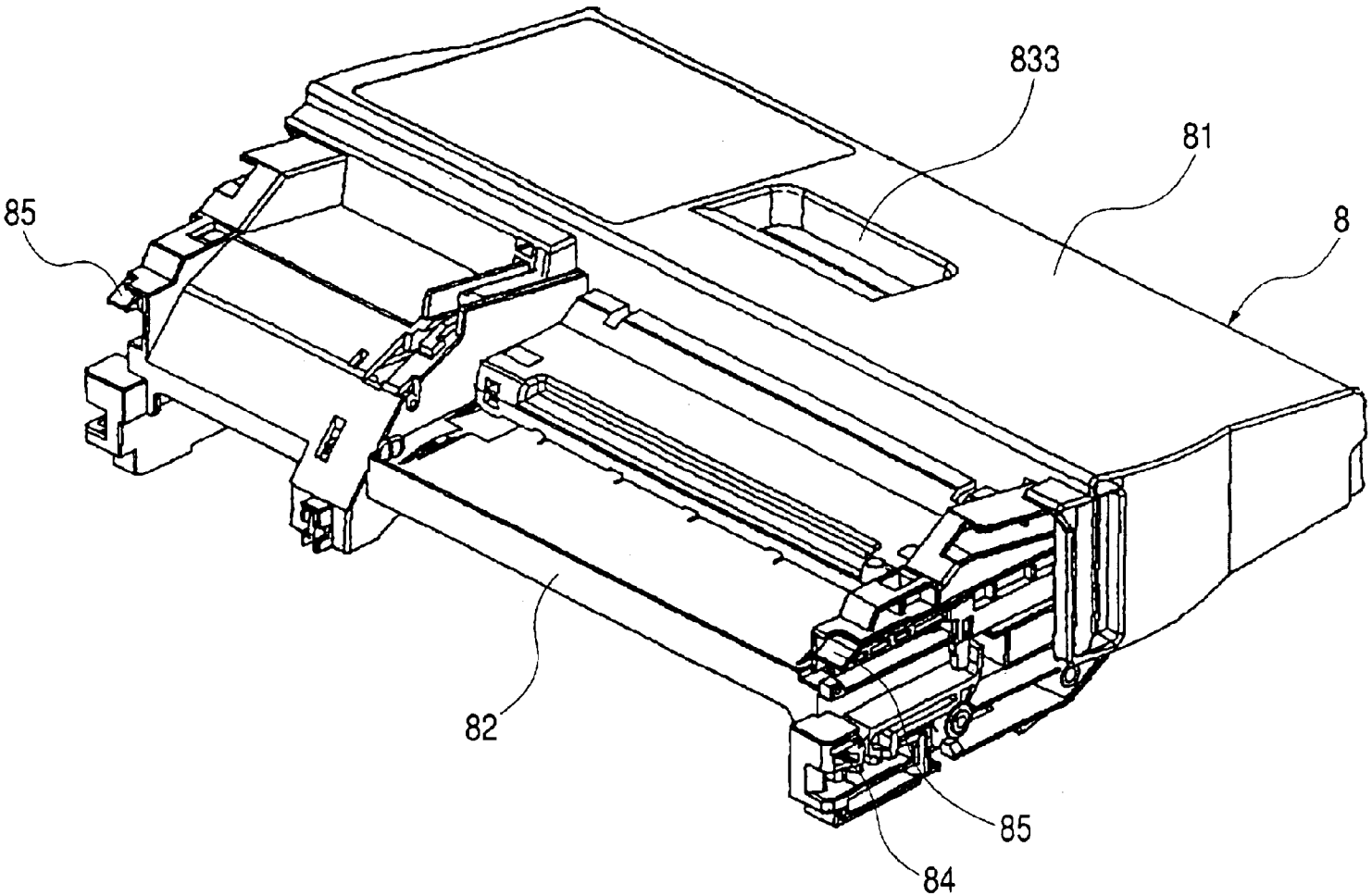
FIG. 7 is a perspective view showing the CD transporting unit attachable to the recording apparatus of FIG. 1.

FIG. 1 is a perspective view showing an embodiment of a recording apparatus to which the present invention is applied. FIG. 2 is a perspective view showing the recording apparatus of FIG. 1 with a sheet feeding tray and a sheet delivery tray opened. FIG. 3 is a perspective view showing an internal mechanism of the recording apparatus of FIG. 1 as viewed from a right-hand front side. FIG. 4 is a perspective view showing an internal mechanism of the recording apparatus of FIG. 3 as viewed from a left-hand front side. FIG. 5 is a longitudinal sectional view showing the recording apparatus of FIG. 3. FIGS. 6A and 6B are perspective views respectively showing states before and after a CD transporting unit 8 is attached to the recording apparatus of FIG. 1. FIG. 7 is a perspective view showing the CD transporting unit 8 attachable to the recording apparatus of FIG. 1.

In FIGS. 1 to 5, a recording apparatus 1 according to the present invention includes: a sheet feeding unit 2; a sheet transporting unit 3; a sheet delivery unit 4; a carriage unit 5; a recovery mechanism unit (cleaning unit) 6; recording means (recording head) 7; a CD transporting unit 8; and an electricity unit 9. Hereinafter, those parts will be schematically described in order on the item basis.

(A) Sheet Feeding Unit

The sheet feeding unit 2 is composed of a base 20 to which a pressure plate 21, a feeding roller 28, a separating roller 241, a return lever 22, etc. are attached. The pressure plate 21 is for loading a sheet material. The feeding roller 28 is for feeding the sheet material. The separating roller 241 separates one sheet of the sheet material from another. The return lever 22 is for returning the sheet material to the loading position. A sheet feeding tray 26, which is for holding the loaded sheet material, is attached to the base 20 or to an external package of the recording apparatus. The sheet feeding tray 26 is of multistage type as shown in FIG. 2, and is pulled out when in use.

The sheet feeding roller 28 is a rod that is shaped like an arc in section. A sheet feeding roller rubber band 281 is placed on the sheet feeding roller 28 at a point close to the sheet reference. A sheet material is fed (sent) by such sheet feeding roller 28. The sheet feeding roller 28 is driven by a driving force transmitted through a driving force transmitting gear and a planet gear from a sheet feeding motor 273, which is provided in the sheet feeding unit 2. The pressure plate 21 has a movable side guide 23 to regulate the loading position of the sheet material. The pressure plate 21 can rotate about a rotation axis coupled to the base 20, and is biased toward the sheet feeding roller 28 by a pressure plate spring 212. A site of the pressure plate 21 that faces the sheet feeding roller 28 is provided with a separating sheet formed of a material that has a large friction coefficient, such as synthetic leather, so as not to feed several upper sheets of the stack of the loaded sheet material at once. The pressure plate 21 is structured such that it can be pressed against or distanced from the sheet feeding roller 28 by a pressure plate cam.

The base 20 also has a separating roller holder 24 attached thereto. The separating roller 241 for separating one sheet of the sheet material from the rest is attached to the separating roller holder 24. The separating roller holder 24 can rotate about the rotation axis coupled to the base 20 and is biased toward the sheet feeding roller 28 by a separating roller spring. A separating roller clutch (clutch spring) 245 is attached to the separating roller 241, so that the portion where the separating roller 241 is attached is rotated when a given load or more is applied to the separating roller 241. The separating roller 241 is structured such that it is pressed against and distanced from the sheet feeding roller 28 by a separating roller release shaft 244 and a control cam. Positions of the pressure plate 21, the return lever 22, and the separating roller 241 are detected by an ASF sensor 29. The return lever 22 for returning the sheet material to the loading position is rotatably attached to the base 20, and is biased in an unlocking direction by a return lever spring. In returning the sheet material to the loading position, the return lever 22 is rotated by the control cam.

How a sheet of paper is fed using the above structure will be described below. In a general stand-by state, the pressure plate 21 is released by the pressure plate cam, the separating roller 241 is released by the control cam, and the return lever 22 is in a position which returns the sheet material to the loading position and which blocks the loading port in order to prevent the sheet material from accidentally entering the interior of the recording apparatus upon loading. Sheet feeding is started from this state and the first step is to bring the separating roller 241 into contact with the sheet feeding roller 28 by driving the motor. Then the return lever 22 is released to press the pressure plate 21 against the sheet feeding roller 28. Now, actual feeding of the sheet material is started. Only a given number of sheets of the sheet material are sent to a nip portion constituted of the sheet feeding roller 28 and the separating roller 241 by regulation of an upstream separating unit, which is provided in the base 20. The sheet material sent to the nip portion is separated there from one another and the topmost sheet alone is transported (fed) forward.

When the sheet material reaches a transport roller pair constructed by a transport roller 36 and pinch rollers 37 which will be described later, the pressure plate 21 and the separating roller 28 are released by the pressure plate cam and the control cam, respectively. The control cam also returns the return lever 22 to the loading position. At this point, the sheet material which has reached the nip portion between the sheet feeding roller 28 and the separating roller 241 becomes ready to return to the loading position.

(B) Sheet Transporting Unit

The sheet transporting unit 3 is attached to a chassis 11, which is obtained by bending and pulling a steel plate up. The sheet transporting unit 3 has the transport roller 36 for transporting the sheet material and a PE sensor. The transport roller 36 is a metal axis coated with fine ceramic particles and is attached to the chassis 11 by resting its metal portion on each end in a bearing. A transport roller tension spring is provided between the bearing and the transport roller 36, so that a given load is applied by biasing the transport roller 36. The load applied to the transporting roller 36 during rotation makes stable transportation possible.

The plural pinch rollers 37 are driven rollers and are in contact with the transport roller 36. The pinch rollers 37 are held by a pinch roller holder 30 and put in a pressed-contact with the transport roller 36 while being biased by a pinch roller spring to generate a force to transport the sheet material. The pinch roller holder 30 rotates about its rotation axis, which is held in a bearing of the chassis 11. A paper guide flapper 33, which guides the sheet material, and a platen 34 are provided at an entrance of the sheet transporting unit 3 to which the sheet material is transported. The pinch roller holder 30 has a PE sensor lever 321 for relaying detection of the front end and rear end of the sheet material to the PE sensor. The platen 34 is positioned when it is attached to the chassis 11. The paper guide flapper 33 can rotate about a bearing unit which makes a sliding motion while being engaged with the transport roller 36. The paper guide flapper 33 is positioned when it is pressed the chassis 11.

A sheet holding-down member that covers an end of the sheet material is provided on the sheet reference side of the platen 34. The sheet holding-down member prevents the end of the sheet material from interfering with a carriage 50 or the recording head 7 overhead even when the end of the sheet material is misshapen or curled. The recording head 7 for forming an image based on image information is on the downstream side in the sheet material transporting direction of the transport roller 36.

In the above structure, the sheet material sent to the sheet transporting unit 3 is guided by the pinch roller holder 30 and the paper guide flapper 33 to be sent into a roller pair composed of the transport roller 36 and the pinch rollers 37. At this point, the front end of the transported sheet material is detected by the PE sensor lever 321 to determine the recording position (printing position or image formation position) on the sheet material. The sheet material is transported over the surface of the platen 34 as the roller pair, namely, the rollers 36 and 37 are rotated by a transport motor 35. Ribs serving as a transport reference face are formed on the surface of the platen 34. The ribs are for management of a gap between the platen 34 and the recording head 7 as well as for preventing, together with the sheet delivery unit which is described later, the sheet material from becoming too wavy by controlling waviness of the sheet material.

The transport roller 36 is driven by transmitting the rotational force of the transport motor 35, which is a DC motor, through a timing belt to a pulley 361 provided on the axis of the transport roller 36. A code wheel 362 is also provided on the axis of the transport roller 36 to detect how far the sheet material is transported by the transport roller 36. Markings are formed on the code wheel 362 at a pitch of 150 lpi to 300 lpi. The markings are read by an encoder sensor attached to a site of the chassis 11 that is adjacent to the code wheel 362.

Employed as the recording means (recording head) 7 is an ink jet recording head. Separate, exchangeable, ink tanks containing ink of different colors are attached to the recording head 7. The recording head 7 can heat the ink by a heater (heater element) or the like in accordance with recording data. As the ink reaches film boiling from the heating, air bubbles grow or shrink to cause a change in pressure. The pressure change causes the ink to jet out of a discharge port of the recording head 7 and the jetted ink drops form an image on the sheet material.

(C) Carriage Unit

The carriage unit 5 has the carriage 50 to which the recording head 7 is attached. The carriage 50 is guided and supported by a guide shaft 52 and a guide rail 111, which are placed in the direction that is at right angles with the sheet material transporting direction, in a manner that allows the carriage 50 to move back and forth in a main scanning direction. The guide rail 111 also has a function of keeping the gap between the recording head 7 and the sheet material (sheet gap) to an appropriate value by holding the rear end of the carriage 50. The guide shaft 52 is attached to the chassis 11 whereas the guide rail 111 and the chassis 11 form an integral body. In order to reduce the noise of sliding, a sliding sheet 53, which is a thin plate of SUS or the like, is placed along a side of the guide rail 111 against which the carriage 50 slides.

The carriage 50 is driven by a carriage motor, which is attached to the chassis 11, through a timing belt 541. The timing belt 541 is stretched and supported by an idle pulley 542. The timing belt 541 is linked to the carriage 50 through a dumper made of rubber or the like. This attenuates vibration of the carriage motor and others and resultantly nonuniformity in a printed image is reduced. The position of the carriage 50 is detected by a code strip 561, which is marked at a pitch of 150 lpi to 300 lpi and which is in parallel to the timing belt 541. The markings on the code strip 561 are read by an encoder sensor, which is provided on a carriage substrate mounted to the carriage 50. The carriage substrate also has a contact for electrical connection with the recording head 7. The carriage 50 has a flexible substrate 57 for transmitting a head signal from the electricity unit (electric substrate) 9 to the recording head 7.

In order to fix the recording head 7 as the recording means to the carriage 50, the carriage 50 is provided with an abutment portion for positioning and depressing means (head depressing means) for depressing and fixing the recording head 7. The depressing means is mounted to a head set lever 51, and rotates with the head set lever 51 about a rotation fulcrum to depress and set the recording head 7. The guide shaft 52 has on its ends an eccentric cam R (right-hand eccentric cam) 521 and an eccentric cam L (left-hand eccentric cam) 522. The driving force of a carriage lifting motor 58 is transmitted through a gear train 581 to the eccentric cam R 521 to lift and lower the guide shaft 52 vertically. As the guide shaft 52 is lifted or lowered, the carriage 50 is similarly lifted or lowered to set an appropriate gap between the carriage 50 and the sheet material irrespective of the thickness of the sheet material.

Also attached to the carriage 50 is a tray position detection sensor 59, which is a reflective photosensor to detect position detection marks 834 (834*a*, 834*b*, and 834*c*) of a CD printing tray 83 for recording (printing) in a display portion of a small-sized, thick, recording material such as a CD-R. The tray position detection sensor 59 detects the position of the tray 83 upon receiving light that is emitted from a light emitting element and then reflected. In forming an image on the sheet material with the above structure, the roller pair (the transport roller 36 and the pinch rollers 37) transports the sheet material to the position where a row is to be recorded (a position in the sheet material transporting direction) while the carriage motor moves the carriage 50 to the recording (image formation) position (position in a direction perpendicular to the sheet material transporting direction) until the recording head 7 faces the recording position (image formation position). Then, upon receiving a signal from the electricity unit (electric substrate) 9, ink jets out of the recording head 7 toward the sheet material for recording (image formation).

(D) Sheet Delivery Unit

The sheet delivery unit 4 is equipped with two sheet delivery rollers 40 and 41, spurs 42 which can be rotated when pressed against the delivery rollers 40 and 41 under a given pressure, and a gear train for transmitting the driving force of the transport roller 36 to the sheet delivery rollers 40 and 41. The sheet delivery rollers 40 and 41 are attached to the platen 34. The sheet delivery roller 40, which is on the upstream side in the transporting direction, is a metal axis having plural rubber portions (sheet delivery roller rubber). The sheet delivery roller 40 is driven by the driving force transmitted from the transport roller 36 through an idler gear.

The sheet delivery roller 41 is a resin axis to which plural elastomers or similar elastic bodies are attached. The sheet delivery roller 41 is driven by the driving force transmitted from the sheet delivery roller 40 through an idler gear.

The spurs 42 are each obtained by, for example, molding as one a resin portion and an SUS thin plate that has plural convex shapes along its perimeter. The spurs 42 thus constructed are attached to a spur holder 43. In this embodiment, a spur spring which is a coil spring shaped like a rod is used to attach the spurs 42 to the spur holder 43 and to press the spurs 42 against the sheet delivery rollers 40 and 41. Some of the spurs 42 mainly generate a force to transport the sheet material and others mainly prevent the sheet material from floating during recording. The spurs for generating the force to transport the sheet material are placed in positions that face the rubber portions (sheet delivery roller rubber portions and elastic body portions) of the sheet delivery rollers 40 and 41. On the other hand, the spurs that prevent the sheet material from floating are placed in positions where the rubber portions of the sheet delivery rollers 40 and 41 are not located (for example, between the rubber portions).

A paper end support is provided between the sheet delivery rollers 40 and 41. The paper end support lifts both ends of the sheet material and holds the sheet material ahead of the sheet delivery rollers 40 and 41 to thereby prevent the image recording portion on the sheet material from being scuffed, which would damage the recorded image or lower the quality thereof. The paper end support is composed of a resin member, which has a runner on its front end, and a paper end support spring. The resin member is biased by the paper end support spring to press the runner against the sheet material under a given pressure. In this way, both ends of the sheet material are lifted giving the sheet material a 'hip' and the paper end support holds the sheet material by its hip.

With the above structure, the sheet material on which an image has been recorded (formed) in the carriage unit 5 is nipped and transported by the nip portion between the sheet delivery roller 41 and the spurs 42, and delivered onto a sheet delivery tray 46. The sheet delivery tray 46 has a breakaway structure and, when broken into plural parts, can be housed in the bottom of a lower case 99 of the recording apparatus. The sheet delivery tray 46 is pulled out when in use. In the sheet delivery tray 46 shown in FIG. 2, the height is increased toward its tip and both edges stand higher than the middle as well. In this way, the sheet material delivered is stacked neatly and the recording face of the sheet material is prevented from being scuffed.

(E) Recovery Mechanism Unit (Cleaning Unit)

The recovery mechanism unit (cleaning unit) 6 has a pump (suction pump or the like to serve as a negative pressure source) 60, a cap 61, and wiping means (blades) 62. The pump 60 is used in a suction recovery process (cleaning operation) for recovering and maintaining the jetting ability of the recording head 7. The cap 61 protects the discharge port face of the recording head 7 and prevents the face from drying. The wiping means 62 wipes away ink, dust, or other incrustation (cleaning) around the discharge port on the discharge port face of the recording head 7. The recovery mechanism unit 6 has a dedicated recovery motor 69. A one-way clutch is included in the recovery mechanism unit 6, so that the recovery motor 69 is rotated in one direction to operate the pump 60 whereas the motor is rotated in the other direction (reverse rotation) to activate the wiping operation of the blades 62 and the lifting and lowering operation of the cap 61.

In this embodiment, the pump 60 is structured to generate a negative pressure by pushing two tubes through pump rollers. A valve and other components are provided in a suction path (a tube or the like) leading from the cap 61 to the pump 60. The suction recovery means suctions and discharges thickened ink, bubbles, and dust or other foreign objects from the discharge port of the recording head 7 along with normal ink by a negative pressure, which is generated in the cap 61 by operating the pump 60 with the cap 61 tightly pulled over the discharge port face of the recording head 7 (capped state).

A cap absorber for reducing the amount of residual ink (crusted ink) on the discharge port face of the recording head 7 after the suction is provided in the cap 61. In order to prevent residual ink from adhering to the cap absorber, the mechanism is structured such that residual ink is suctioned and removed from the interior of the cap 61 through an idle suction action in which the suction pump 60 is operated with the cap 61 open. The waste ink suctioned out by the pump 60 is absorbed and held in a waste ink absorber 991 placed in the lower case 99, which is described later.

Various recovery process operations in the recovery mechanism unit 6, namely, a series of recovery operations including the wiping operation by the blades 62, the contacting and distancing operation (lifting and lowering operation) of the cap 61, and the opening and closing operation of the valve located between the cap 61 and the pump 60, are controlled by a main cam, which is composed of plural coaxial cams. Each given recovery process operation is achieved by operating relevant cams, arms (levers), and the like corresponding to each of the recovery process operations with the main cam. The position of the main cam (rotation position or the like) is detected by a position detection sensor which is, for example, a photo interrupter. When the cap 61 is apart from the recording head (when the cap 61 is lowered in this embodiment), the blades 62 are moved in a direction that is at right angles with the main scanning direction of the carriage 50 to wipe (clean) the discharge port face of the recording head 7. In this embodiment, the blades 62 are composed of a blade for wiping the vicinity of the discharge port face of the recording head 7 and a blade for sweeping the entire discharge port face. When moved to the farthest point in the back, the blades 62 are pressed against a blade cleaner 66 and ink (transfer ink) or the like adhering to the blades 62 is removed to recover the wiping ability of the blades 62.

(F) External Package Unit

The functional units and mechanism units (each unit) described above are incorporated in the chassis 11 of the recording apparatus 1 to constitute the mechanism portion of the recording apparatus. The mechanism portion is entirely covered with an external package. The external package unit is mainly composed of the lower case 99, an upper case 98, an access cover 97, a connector cover 96, and a front cover 95. A sheet delivery tray rail is laid on the bottom of the lower case 99, so that the sheet delivery tray 46 is housed in the lower case 99 after broken into parts. The front cover 95 blocks the sheet delivery port when it is not in use.

The access cover 97 is rotatably attached to the upper case 98. An opening is formed in a part of the top face of the upper case 98. The opening is for replacing an ink tank, the recording head 7, and other exchangeable components. The upper case 98 has a door switch lever for detecting opening and closing of the access cover 97, an LED guide 982 for transmitting light from an LED to an indicator, a key switch 983 for SW of the electricity unit (circuit substrate) 9, and the like. The upper case 98 also has the multistage sheet feeding tray 26 attached thereto in a rotatable manner. The sheet feeding tray 26 can be put away to function as a cover of the sheet feeding unit when the sheet feeding unit is not in use. The upper case 98 and the lower case 99 are attached to each other by an elastic engaging claw. The area where the connector between the upper case 98 and the lower case 99 is located is covered with the connector cover 96.

Figure 8:
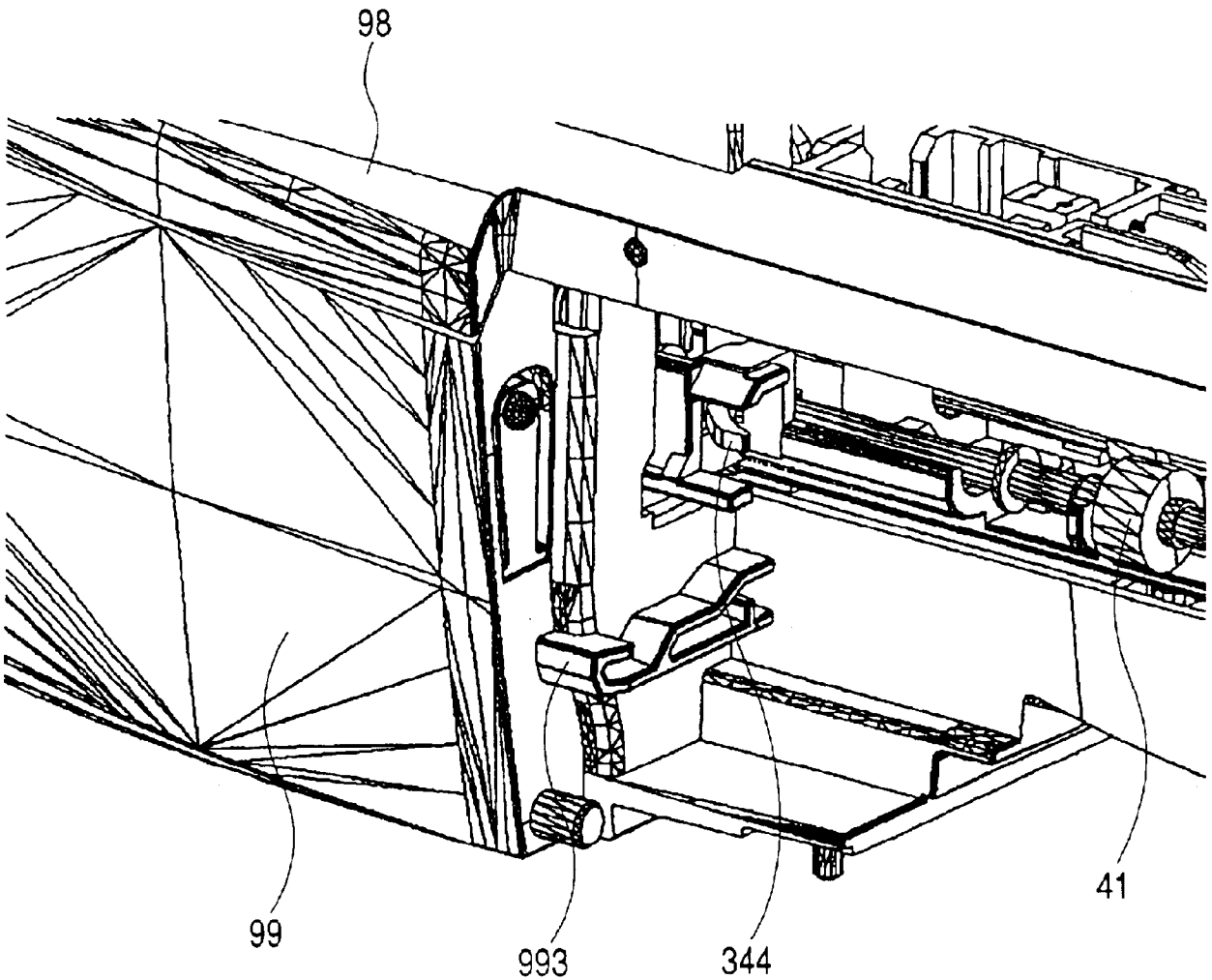
FIG. 8 is a partial perspective view showing a CD transporting unit attachment unit of a lower case and an attachment detecting unit thereof in the recording apparatus to which the present invention is applied.
Figure 9:
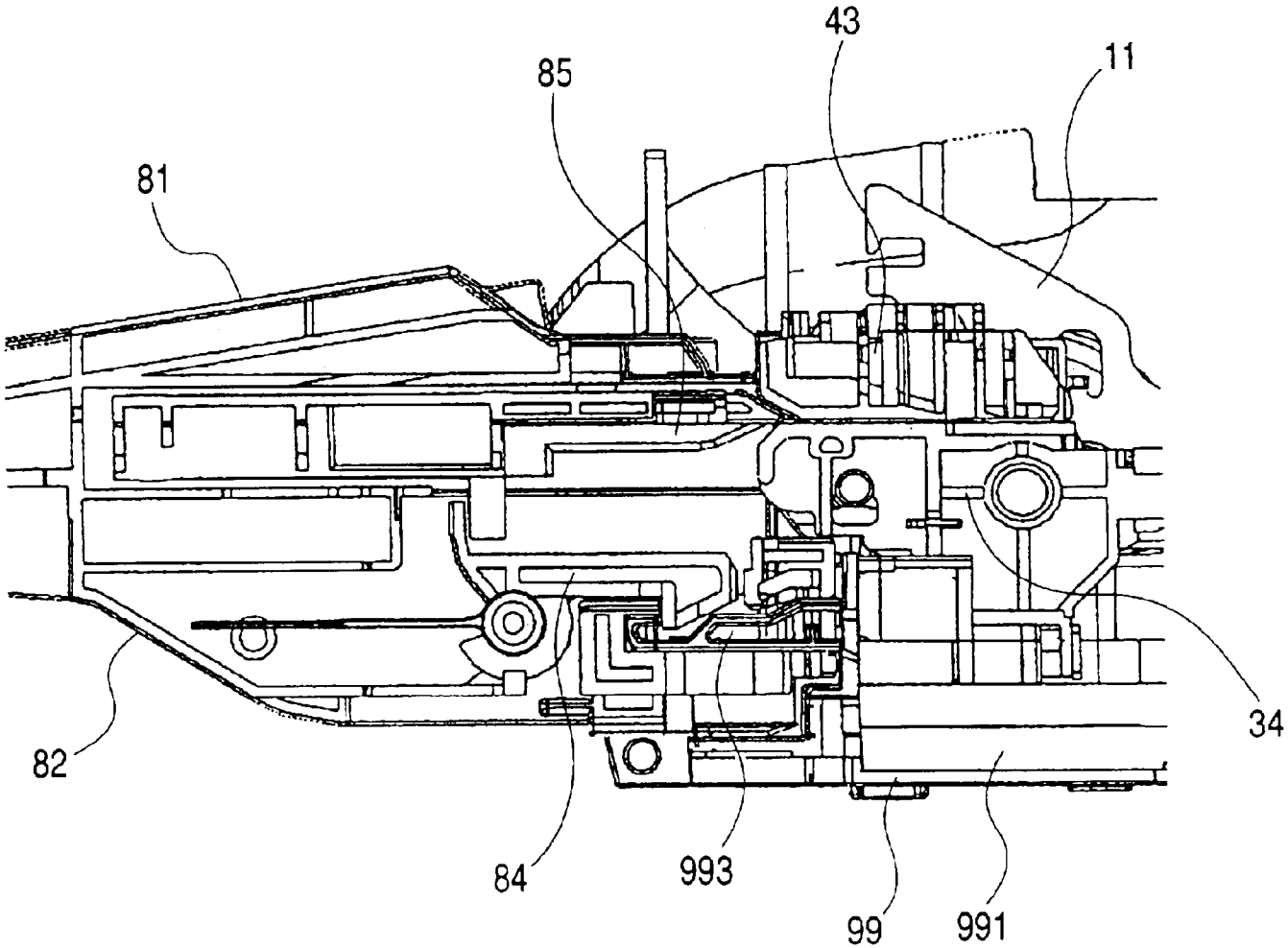
FIG. 9 is a partial longitudinal sectional view showing how a hook of the CD transporting unit is attached to the lower case of the recording apparatus to which the present invention is applied.
Figure 10A:
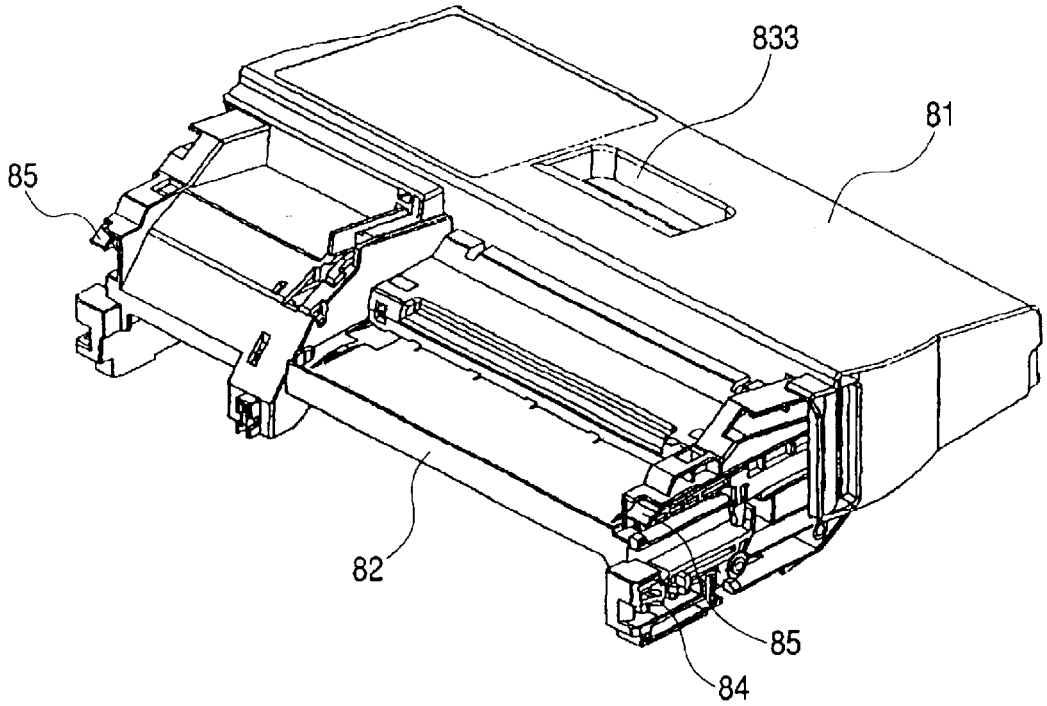
FIG. 10A is a perspective view showing a state of the CD transporting unit attachable to the recording apparatus to which the present invention is applied before being attached to the recording apparatus.
Figure 10B:
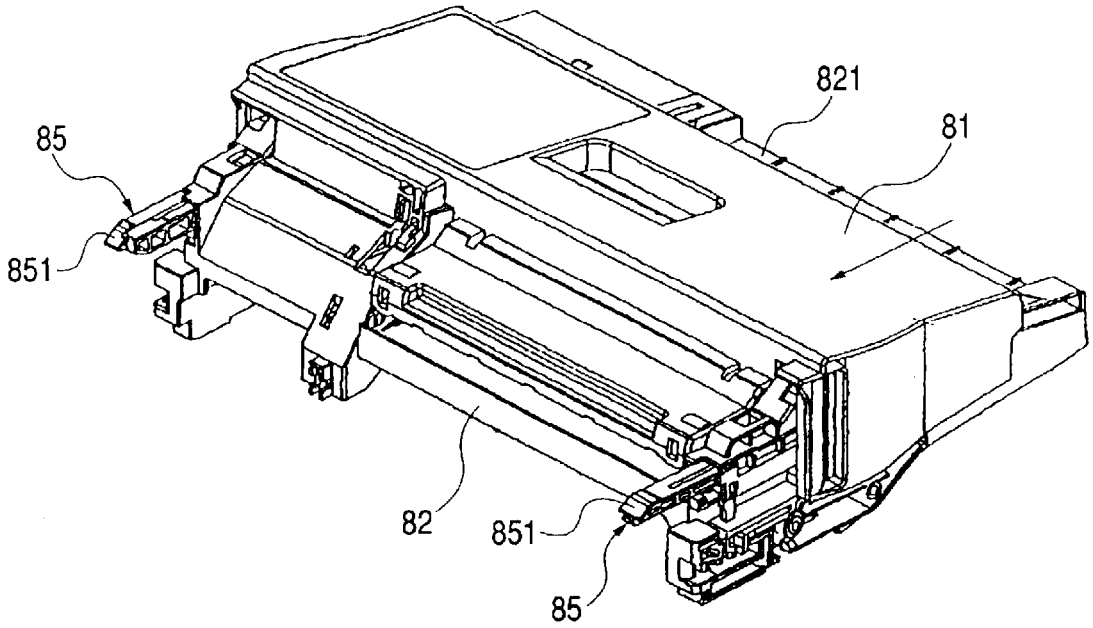
FIG. 10B is a perspective view showing a state where a slide cover is moved after the CD transporting unit is attached to the recording apparatus.
Figure 11:
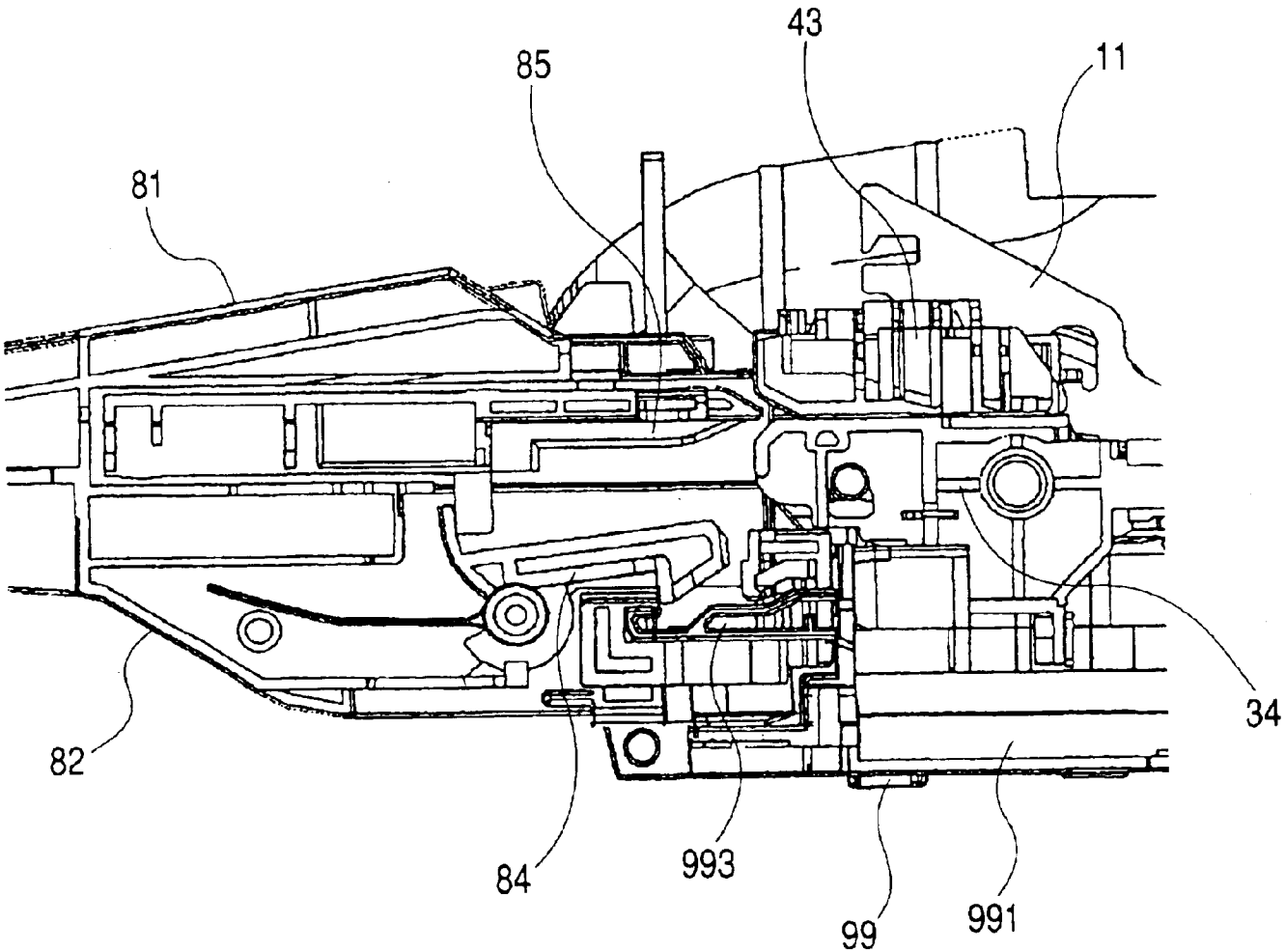
FIG. 11 is a partial longitudinal sectional view showing how the hook of the CD transporting unit is detached from the lower case of the recording apparatus to which the present invention is applied.
Figure 12A:
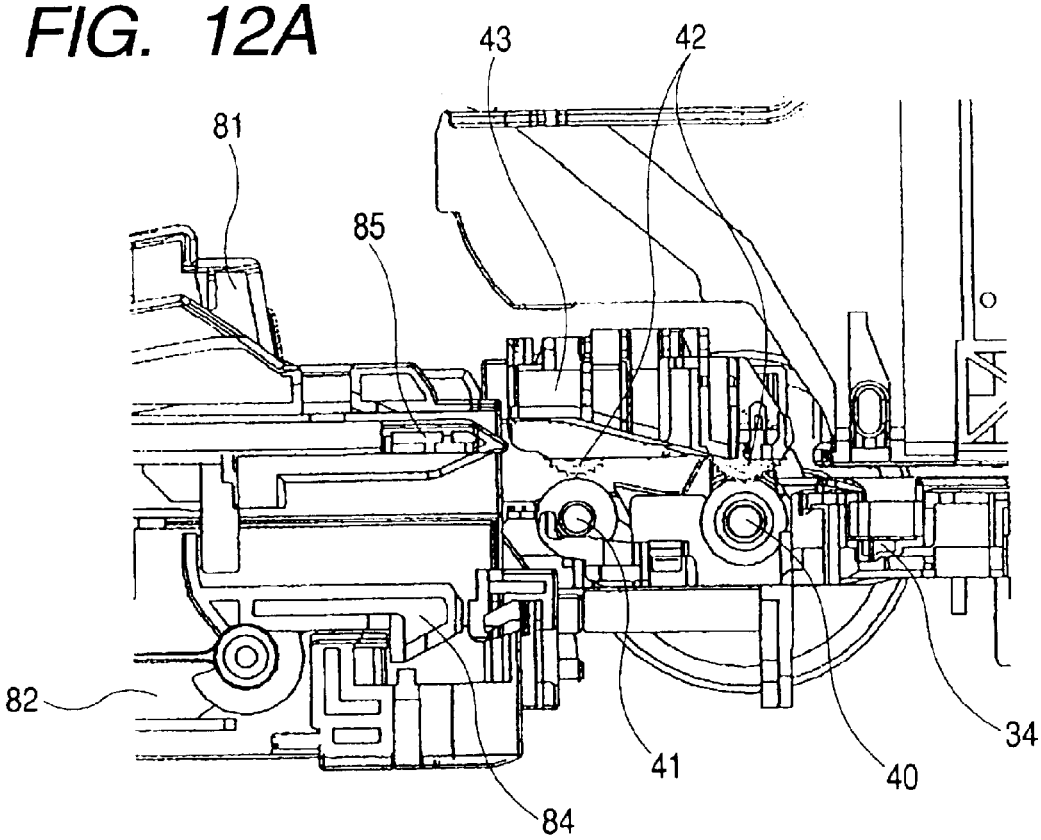
FIG. 12A is a partial vertical sectional view showing a state of an arm before the slide cover of the CD transporting unit is moved in the recording apparatus to which the present invention is applied.
Figure 12B:
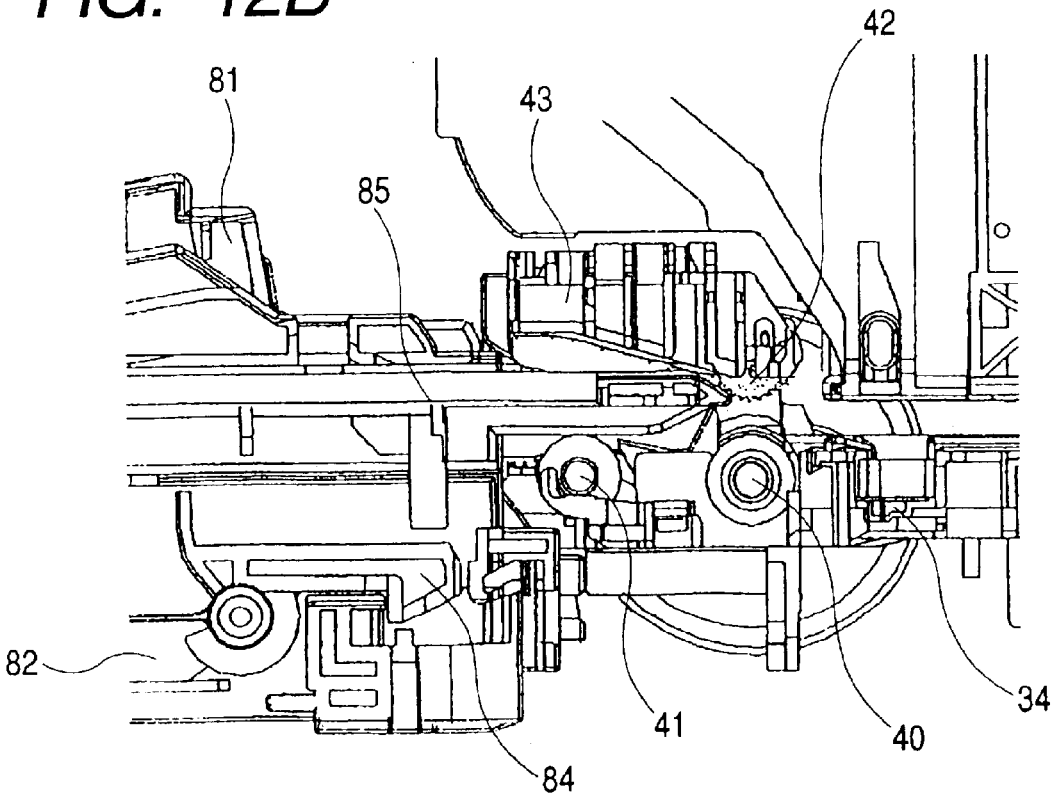
FIG. 12B is a partial vertical sectional view showing a state of the arm after the slide cover of the CD transporting unit is moved.

Next, with reference to FIGS. 6A to 19, a detailed description will be given of, in the recording apparatus to which the present invention is applied, its structure and CD printing in the case of using the CD (compact disc) transporting unit 8. FIGS. 6A and 6B are perspective views respectively showing states before and after the CD transporting unit 8 is attached to the recording apparatus of FIG. 1. FIG. 7 is a perspective view showing the CD transporting unit 8 attachable to the recording apparatus of FIG. 1. FIG. 8 is a partial perspective view showing a CD transporting unit attachment unit of a lower case 99 and an attachment detecting unit thereof. FIG. 9 is a partial longitudinal sectional view showing how a hook 84 of the CD transporting unit 8 is attached to the lower case 99. FIG. 10A is a perspective view showing a state of the CD transporting unit 8 before being attached to the recording apparatus and FIG. 10B is a perspective view showing a state where a slide cover 81 is moved after the CD transporting unit 8 is attached to the recording apparatus. FIG. 11 is a partial longitudinal sectional view showing how the hook 84 of the CD transporting unit 8 is detached from the lower case 99. FIGS. 12A and 12B are partial longitudinal sectional views respectively showing states of an arm 85 before and after the slide cover 81 of the CD transporting unit 8 is moved.

Figure 13:
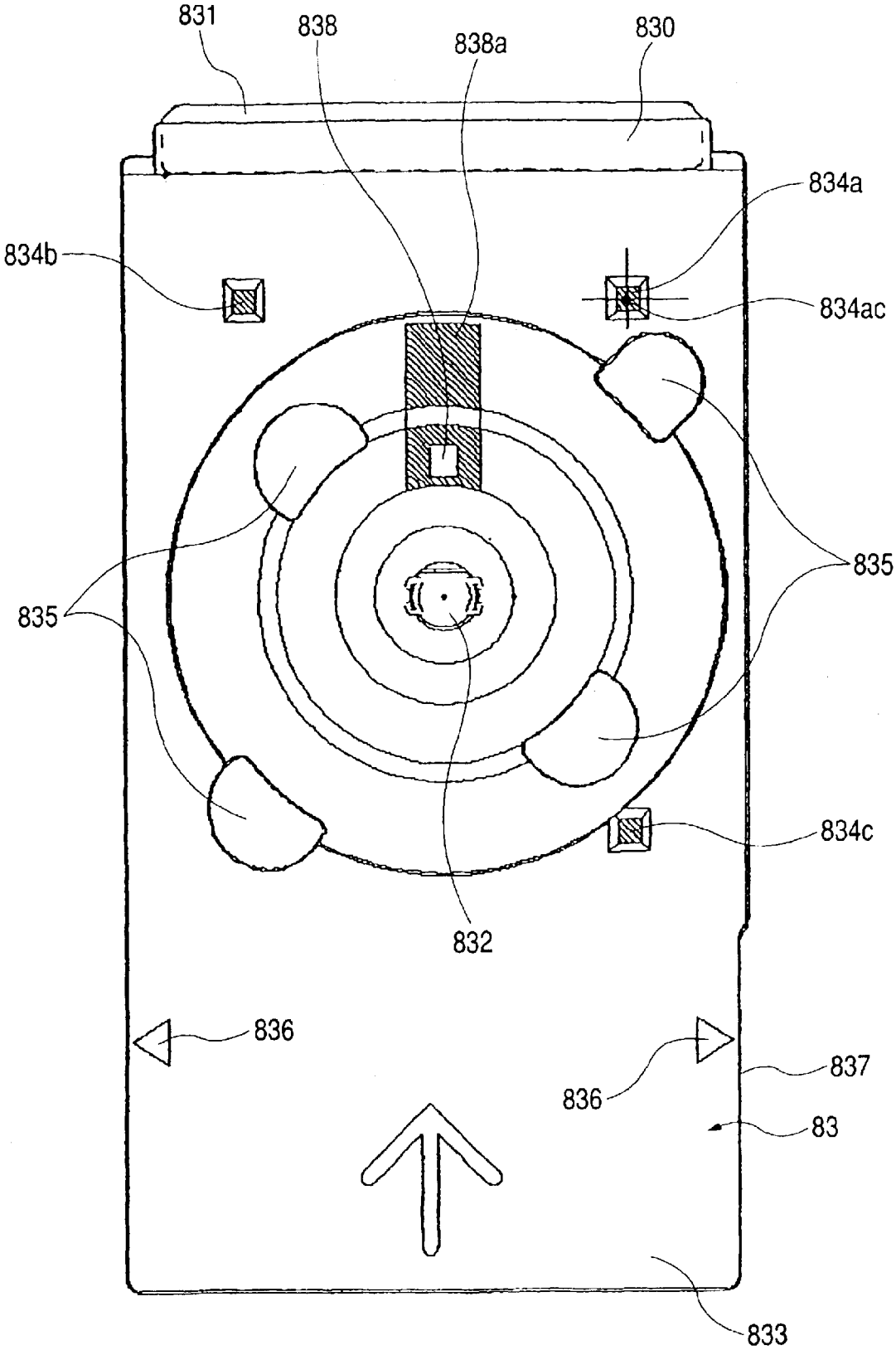
FIG. 13 is a plan view showing a tray of the CD transporting unit of the recording apparatus to which the present invention is applied.
Figure 14:
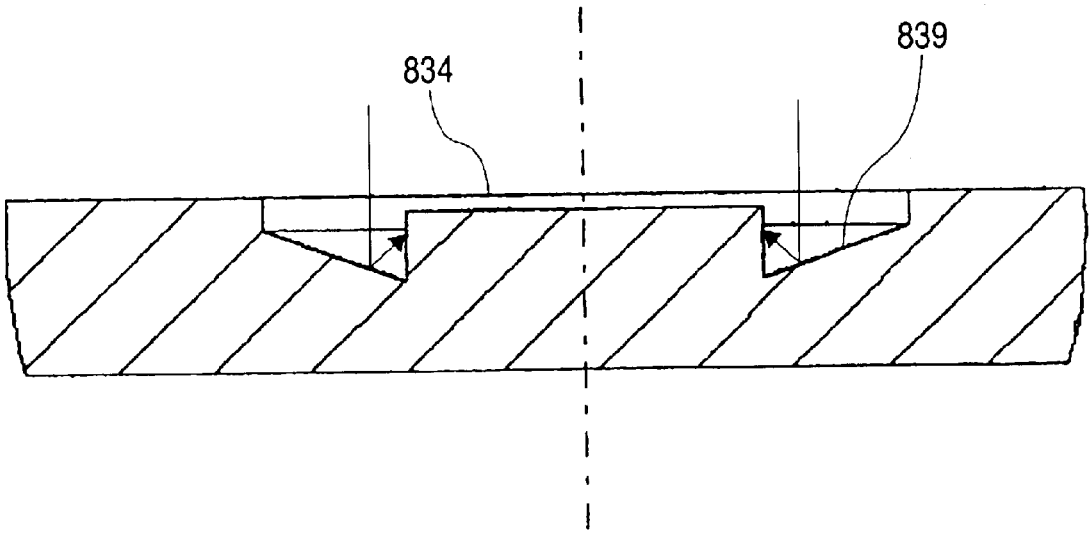
FIG. 14 is a schematic sectional view showing a concave portion shape of a position detecting unit of the tray of FIG. 13.
Figure 15A:
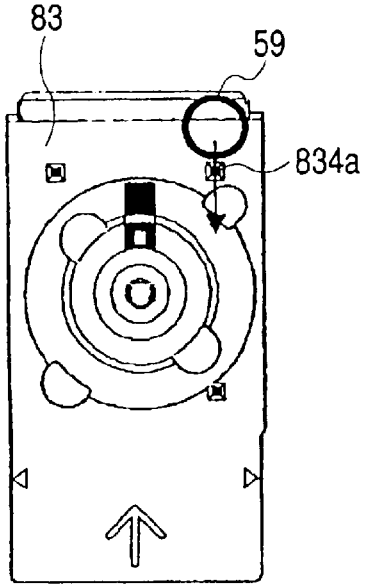
FIGS. 15A, 15B, 15C, 15D, 15E, and 15F are schematic plan views showing various states concerning a relative position between the tray of FIG. 13 and a tray position detection sensor.
Figure 15B:
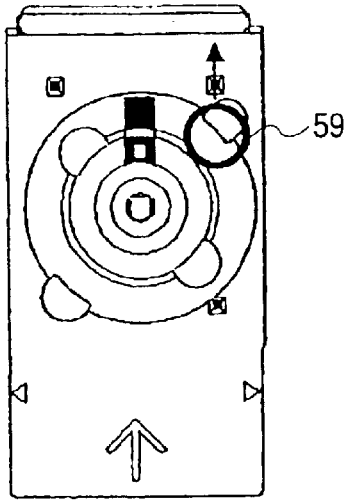
Figure 16:
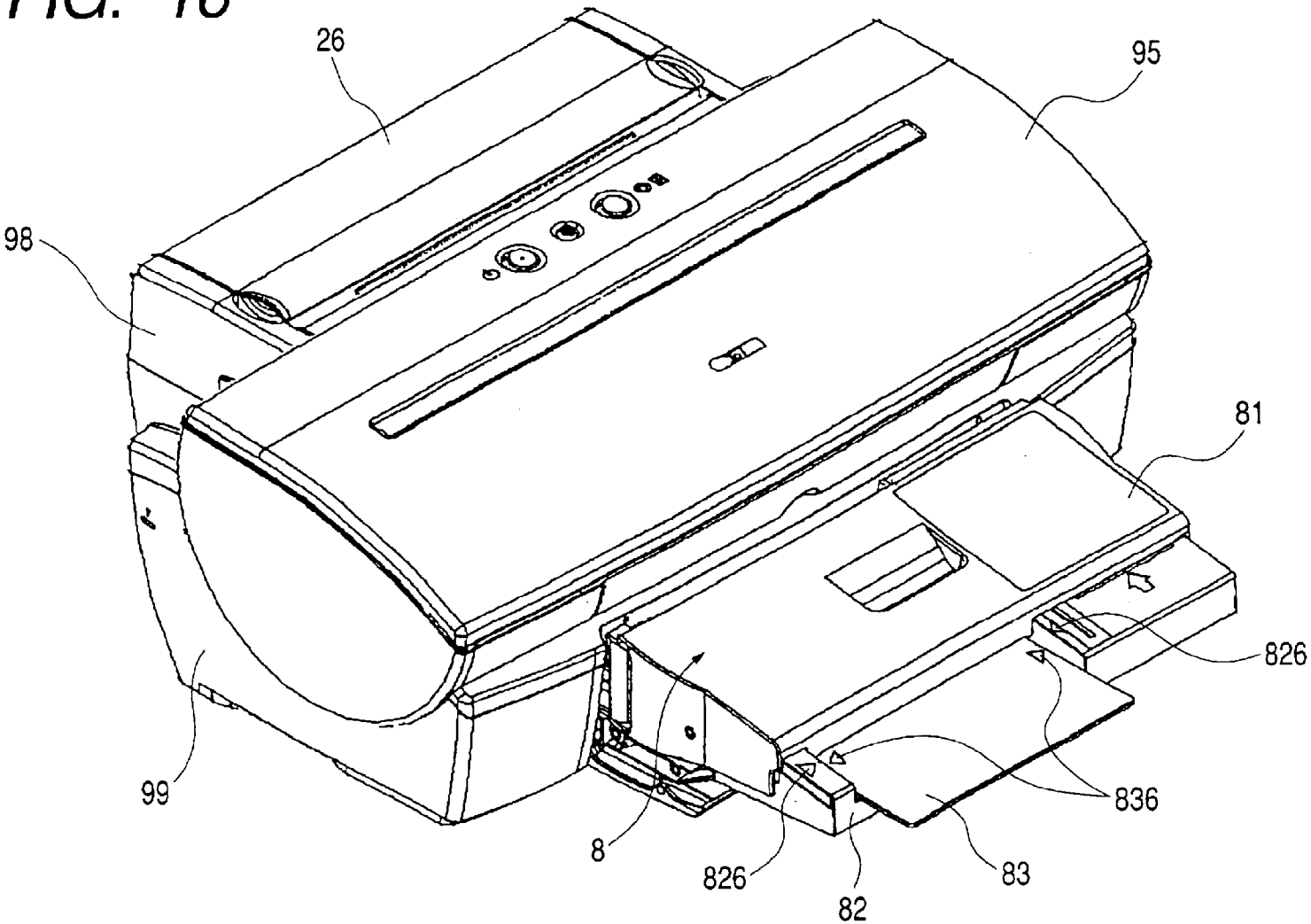
FIG. 16 is a perspective view showing how the tray is set while being inserted into the CD transporting unit attached to the recording apparatus to which the present invention is applied.
Figure 17:
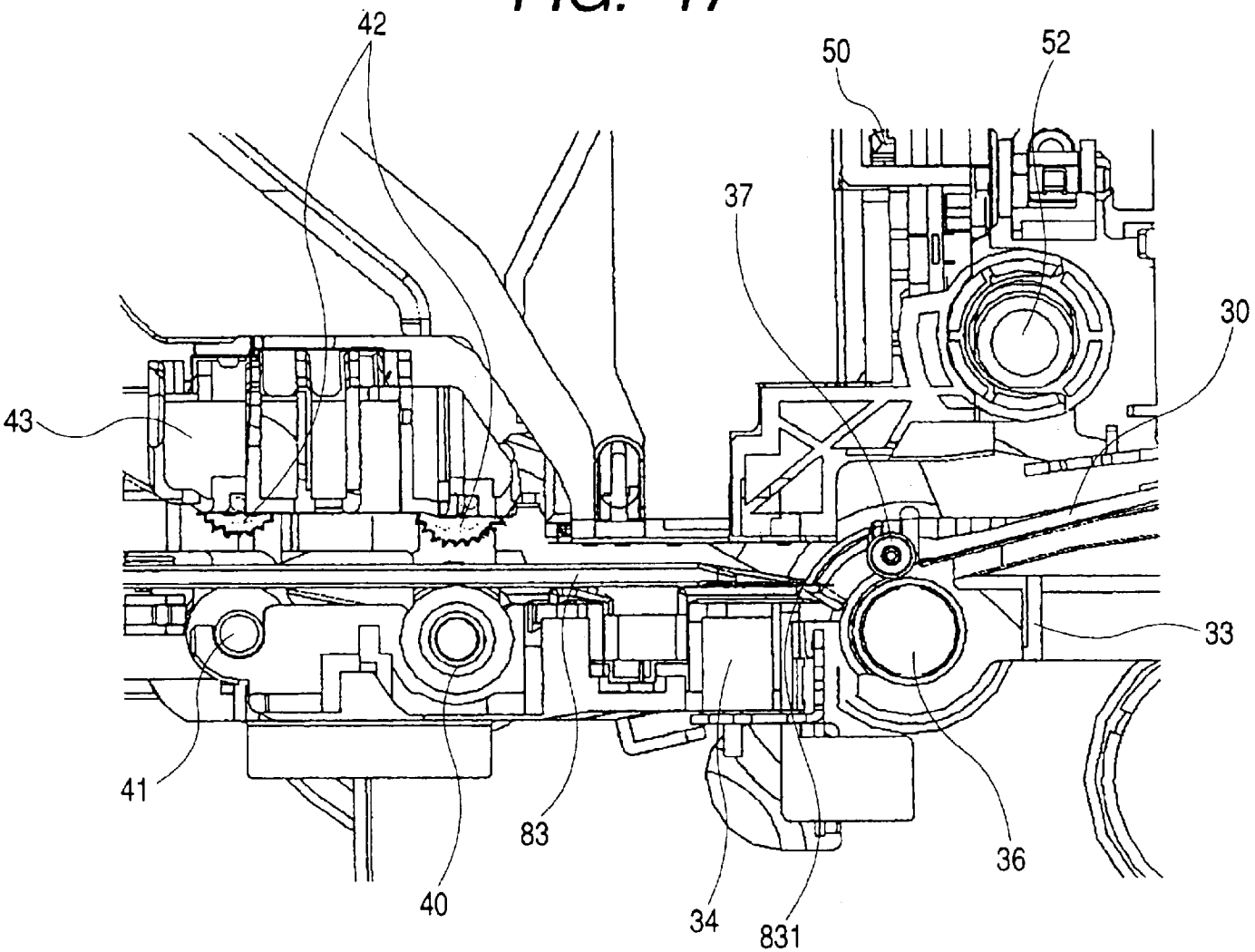
FIG. 17 is a partial longitudinal sectional view showing how the tray is transported within the recording apparatus to which the present invention is applied.
Figure 18A:
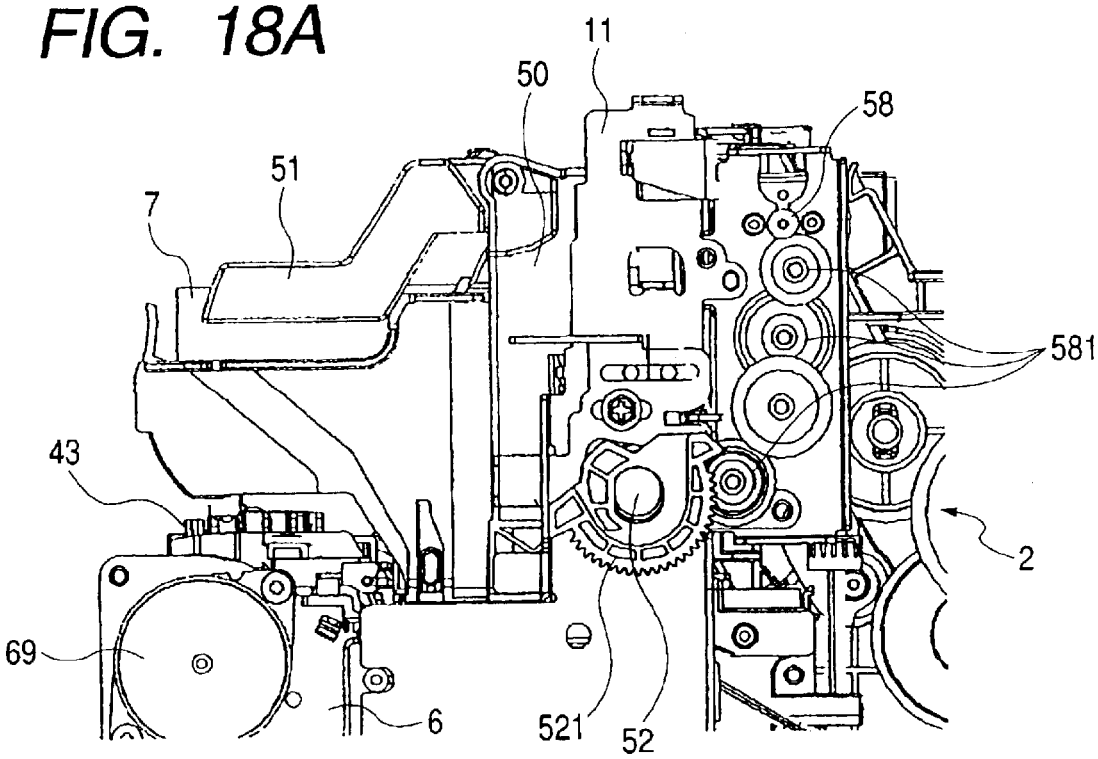
FIG. 18A is a partial vertical sectional view showing a state when a carriage of a shaft lifting mechanism for lifting and lowering a guide shaft of the carriage in the recording apparatus to which the present invention is applied is lowered.
Figure 18B:
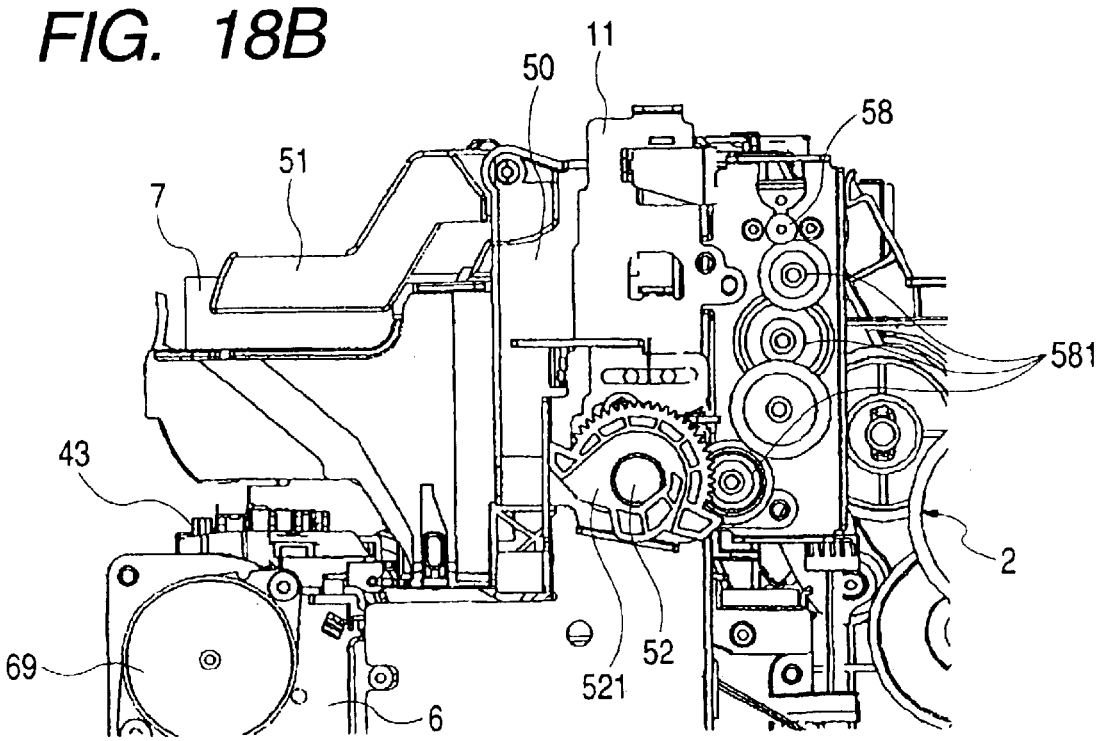
FIG. 18B is a partial vertical sectional view showing a state when the carriage is lifted.
Figure 19:
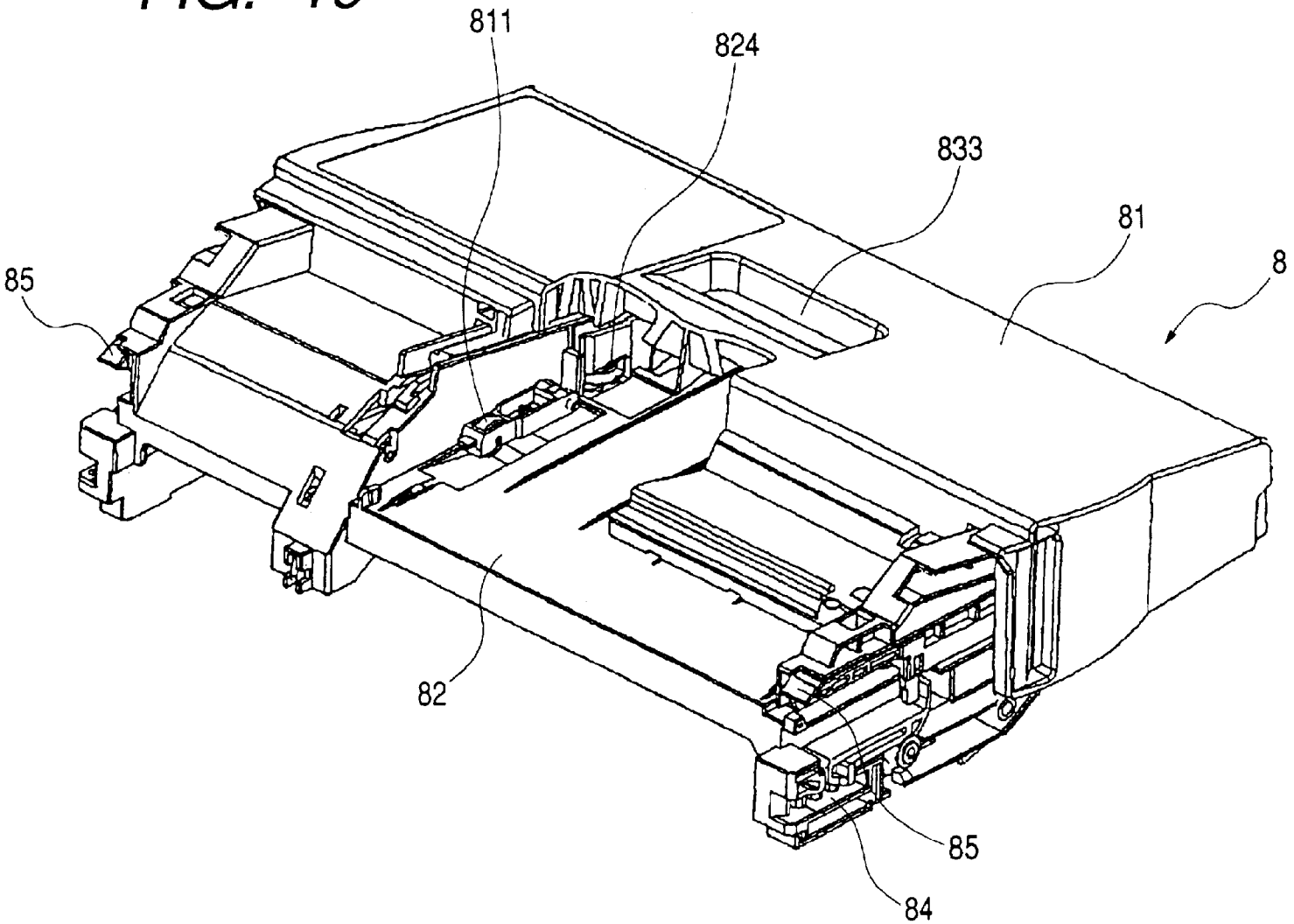
FIG. 19 is a perspective view showing the CD transporting unit attached to the recording apparatus to which the present invention is applied in a partially exploded manner for the purpose of illustrating a pressure runner and a lateral pressure runner thereof.

Further, FIG. 13 is a plan view showing a tray 83 of the CD transporting unit 8. FIG. 14 is a schematic sectional view showing a concave portion shape of a position detecting unit of the tray 83 of FIG. 13. FIGS. 15A, 15B, 15C, 15D, 15E, and 15F are schematic plan views showing various states concerning a relative position between the tray of FIG. 13 and a tray position detection sensor 59. FIG. 16 is a perspective view showing how the tray 83 is set while being inserted into the CD transporting unit 8 attached to the recording apparatus. FIG. 17 is a partial longitudinal sectional view showing how the tray 83 is transported within the recording apparatus. FIG. 18A is a partial vertical sectional views showing the state when the carriage 50 of a shaft lifting mechanism for lifting and lowering a guide shaft 52 of the carriage 50 is lowered. FIG. 18B is a partial vertical sectional views showing the state when the carriage 50 is lifted. FIG. 19 is a perspective view showing the CD transporting unit 8 in a partially exploded manner for the purpose of illustrating a pressure runner 811 and a lateral pressure runner 824 thereof.

As shown in FIG. 6B, the CD transporting unit 8 is fit in the lower case 99 of the recording apparatus by sliding the CD transporting unit 8 straight in the direction of an arrow Y in the figure. At this point, the CD transporting unit 8 is positioned by inserting an engagement portion on each edge of the tray guide 82 along a guide rail 933 that is provided on each side of the lower case 99 shown in FIGS. 8 and 9. The rotatable hook 84 is provided on the left and right side edge of the tray guide 82 each. The hook 84 is biased in one direction. The CD transporting unit 8 is slid and inserted until it abuts against a certain component, so that it is no longer inserted past a given point. Then the hook 84 works on a stopper of the guide rail 993 to lock the CD transporting unit 8 at the given point and prevent the CD transporting unit 8 from sliding back the way the unit has been slid. That the tray guide 82 (CD transporting unit 8) is set at the given point in the recording apparatus is mechanically detected by a tray guide detection sensor 344, which is placed on the platen 34. When the tray guide 82 is attached to the main body of the recording apparatus, a part of the tray guide 82 pushes the tray guide detection sensor 344 and thus attachment of the CD transporting unit 8 (tray guide 82) is detected.

Next, as shown in FIGS. 10A, 10B, 11, 12A, and 12B, the slide cover 81 is moved toward the main body of the recording apparatus (toward the main body side) while the motion of the slide cover 81 makes the arm 85 protrude in the direction of the recording apparatus main body in conjunction of the motion of the slide cover. The spur holder 43 holding the spurs 42 is attached to the platen 34 in a manner that allows the spur holder 43 to move up and down, and is biased downward by the force of a spring at a given pressure. When the arm 85 enters between the spur holder 43 and the platen 34, the spur holder 43 is lifted to a given degree. The arm 85 enters the gap between the platen 34 and the spur holder 43 smoothly owing to a sloped portion 851 at the tip of the arm 85. In this way, a space for allowing the passage of the tray 83 mounted with such a recording medium as CD (or CD-R) is formed between the platen 34 and the spur holder 43.

The arm 85 is positioned as it is inserted between the platen 34 and the spur holder 43. Before protruding (moving forward), the arm 85 is housed in the tray guide 82 with a space to rattle around. The tray 83 cannot be inserted until the slide cover 81 is moved in the direction of the recording apparatus main body because otherwise an opening 821 of the CD transporting unit 8 is closed. As the slide cover 81 is moved in the direction of the recording apparatus main body, the slide cover 81 moves upward at an angle. This forms the opening 821 for insertion of the tray between the slide cover 81 and the tray guide 82. With the slide cover 81 moved out, the tray 83 loaded with a CD can be inserted into the opening 821 and set at a given position as shown in FIG. 16. This structure is chosen to prevent interference between the tray 83 and the spurs 42 which takes place when the tray 83 is inserted without lifting the spur holder 43 and which could damage a tray sheet 831 at the front end of the tray 83 as well as the spurs 42.

When the slide cover 81 is pulled out of the main body with the tray guide 82 attached as shown in FIG. 11, the arm 85 is detached from the spur holder 43 in conjunction with the motion of the slide cover 81 to lower the spur holder 43 and the spurs 42 to their original positions. If the tray 83 remains attached at this point, the tray 83 is stuck in the opening 821 between the slide cover 81 and the tray guide 82 making it impossible to pull out the slide cover 81 any further. This is to avoid an inconvenience of damaging a recording medium such as a CD or a CD-R left in the main body of the recording apparatus with the lowered spurs 42. When the slide cover 81 is pulled further, as shown in FIG. 11, the slide cover 81 works on the hook 84 to unhook the hook 84 from the guide rail 993 of the lower case 99 and detach the CD transporting unit 8 from the main body of the recording apparatus.

The tray 83 according to this embodiment is a resin plate with a thickness of 2 to 3 mm. As shown in FIG. 13, the resin plate has a CD attachment portion 832; a handle portion 833 which is grabbed by an operator in pulling the tray in and out; the position detection marks 834 (in FIG. 13, 834*a*, 834*b*, and 834*c*, three marks in total); CD take out holes 835; insertion positioning marks 836; a lateral pressure runner clearance 837; a media presence detection mark 838; and a tray adaptor type detection mark 838*a* provided for discriminating the type of a tray adaptor. The tray sheet 831 attached to the front end of the tray 83 is for ensuring that the tray 83 is gripped between the transport roller 36 and the pinch rollers 37.

Of the position detection marks 834, two (834*a* and 834*b*) are in the front half of the CD attachment portion of the tray 83 and one (834*c*) is on the opposite side of the two. Each of the position detection marks 834 is formed of a highly reflective material and shaped into a 3 to 10 mm square. Here, the position detection marks 834 are formed by hot stamp. The position detection marks 834 are each surrounded by a concave portion 839 as shown in FIGS. 13 and 14 so that the reflective material is formed into the shape of the resin component position detection marks 834. As shown in FIG. 14, the bottom of the concave portion 839 has excellent surface properties and is inclined at a given angle. Accordingly, if light emitted from the tray position detection sensor 59 (FIG. 4 and FIGS. 15A to 15F) mounted on the carriage 50 is reflected not by the position detection marks 834 but by their surrounding areas, the reflected light is prevented from reaching the light receiving portion. An error in detecting the position of the tray 83 is thus avoided.

Since the position detection marks 834 on the tray 83 have high reflectivity as described above, the sensor mounted does not need to be of high performance and correction or similar process is reduced in number. In this way, an increase in cost or recording time (printing time) is avoided. Compared to the method in which the edge of the print region (recording region) of a CD is directly read, the position of a CD can be detected more accurately even when printing on a colored CD or when reprinting on an already printed CD. The CD attachment portion 832 has a plurality of mold claws for positioning and fixing a CD in the tray without allowing the CD to rattle around. An operator fits a CD to the tray by positioning the center hole in a CD to the CD attachment portion 832. To remove the CD, an operator picks up the CD by its edge (circumference) utilizing the two CD take out holes 835. The CD attachment portion 832 is one step lower than the rest of the tray 83 and the media presence detection mark 838 for detecting the presence or absence of a CD is located on the lowered level. The media presence detection mark 838 for detecting the presence or absence of a CD is obtained by opening a hole of a given width in a hot stamp of a given width, and the absence of a media is recognized when this hole width is detected.

As shown in FIG. 13, the tray sheet 831 is attached to the front end of the tray 83, so that the tray 83 is securely nipped between the transport roller 36 and the pinch rollers 37. The tray sheet 831 is a sheet material which is formed of PET or the like and which is 0.1 to 0.3 mm in thickness. The tray sheet 831 has a given friction coefficient and a given degree of hardness. The tray 83 itself is tapered at the front end thereof (tapered portion 830). The tray sheet 831 is first gripped between the transport roller 36 and the pinch rollers 37 to generate a transportation force, and then the tapered portion 830, which is the front end of the tray 83, lifts the pinch rollers 37 to enable the transport roller 36 and the pinch rollers 37 to nip the thick tray 83 between them. The tray 83 can thus be transported accurately. The position detection marks 834 are placed between the pinch rollers 37. Accordingly, the position detection marks 834 do not come into contact with the pinch rollers 37 and there is no fear of damaging the surfaces of the position detection marks 834.

In FIG. 19, the tray guide 82 constituting the CD transporting unit 8 is provided with the lateral pressure runner 824 for pushing the tray 83 shown in FIG. 13 against a reference of the tray guide 82. Using a runner spring, the lateral pressure runner 824 pushes the tray 83 against the reference at a given pressure for positioning. The lateral pressure runner 824 exerts its effect until an operator sets the tray 83 at a given position. The lateral pressure runner 824 no longer works on the tray 83 once the tray 83 is transported by the transport roller 36 and the pinch rollers 37 to move the lateral pressure clearance 387 (FIG. 13) into the point where the effect of the lateral pressure runner 824 is received. This structure is employed to avoid unnecessary back tension on the tray 83 and thus prevent the accuracy in transporting the tray 83 from lowering.

As shown in FIG. 19, the pressure runner 811 is provided on the left and right side of the slide cover 81 each. Using a runner spring, the pressure runner 811 pushes the tray 83 against the sheet delivery roller 41 to generate a force to transport the tray 83. The transportation force sends the tray 83, which is at a set position at the start of recording (printing), to the nip portion between the transport roller 36 and the pinch rollers 37. As the recording (printing) is finished, the same transportation force sends the tray 83 to a given point where the tray 83 is taken out by an operator. In this case as well, the position detection marks 834 and the pressure runner 811 are located in different places in order to prevent the position detection marks 834 from coming into contact with the pressure runner 811 and scarring their surfaces. Once transported to the given point, the tray 83 is pulled out of the tray guide 82. Then an operator picks up the CD by its edge (circumference) from the tray 83 utilizing the two CD take out holes 835.

A description given next is about the operation of the recording apparatus structured as above in recording on a CD. First, the CD transporting unit 8 is slid straight toward the main body of the recording apparatus 1 until the unit is attached to the lower case 99. At this point, the tray guide detection sensor 344 (FIG. 8) detects the tray guide 82 being attached to the main body of the recording apparatus. Then the slide cover 81 is moved toward the main body of the recording apparatus and the arm 85 protrudes in the direction of the main body of the recording apparatus in conjunction with the motion of the slide cover 81 as shown in FIG. 10B. The arm 85 enters the gap between the spur holder 43 and the platen 34 to lift the spur holder 43 to a given degree.

Moved in the direction of the main body of the recording apparatus, the slide cover 81 slides upward at an angle and the opening 821 (FIG. 6B) is formed between the slide cover 81 and the tray guide 82. In this state, the tray 83 loaded with a CD is inserted into the opening 821 and set at a given position as shown in FIG. 16. The CD is fit to the CD attachment portion 832 (FIG. 13) of the tray 83. An operator grabs the handle portion 833 (FIG. 13) to insert the tray 83 until the insertion positioning marks 836 (FIGS. 13 and 16) match tray set marks 826 (FIG. 16) of the tray guide 82.

When a recording signal (printing signal or video signal) is sent from a host in this state, the recording operation (printing operation) is started. First, the transport roller 36, the sheet delivery roller 40, and the sheet delivery roller 41 rotate backward as shown in FIG. 17. To elaborate, the pressure runner 811 (FIG. 19) and the runner spring push the tray 83 against the sheet delivery rollers 40 and 41 under a given pressure to generate a force to transport the tray 83 in FIG. 17 and the backward rotation of the sheet delivery rollers 40 and 41 leads the tray 83 into the interior of the recording apparatus. As the tray sheet 831 (FIG. 13) at the front end of the tray 83 is gripped between the transport roller 36 and the pinch rollers 37, a given amount of transportation force is generated and the tapered portion 830, which is the front end of the tray 83, lifts the pinch rollers 37 to enable the transport roller 36 and the pinch rollers 37 to nip the tray 83.

Next, the carriage 50 mounted with the recording head 7 moves from its home position to the recording region (printing region) in order to detect the tray 83. At this point, as shown in FIG. 18B, the carriage lifting motor 58 (FIG. 3) is put into operation and lifts the guide shaft 52 to form the optimum gap between the recording head 7 and the tray 83. The carriage 50 stops moving when the tray position detection sensor 59 on the carriage 50 arrives at the position of the position detection mark 834*a* (FIG. 13) on the tray 83. Then the tray 83 is transported and the position of the upper edge (front edge) of the position detection mark 834*a* is detected (FIG. 15A). The transportation is continued and the lower edge (rear edge) of the mark 834*a* is detected (FIG. 15B).

Figure 15C:
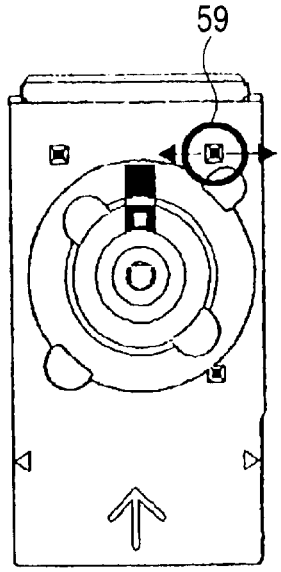

As shown in FIG. 15C, the tray 83 is then moved back until the tray position detection sensor 59 on the carriage 50 arrives at or near the center of the position detection mark 834*a* of the tray 83. The carriage 50 is moved to the left or right to detect the positions of the right and left edges of the position detection mark 834*a*. A center position 834*ac* (FIG. 13) of the position detection mark 834*a* is thus calculated and the accurate recording position (printing position) of the CD loaded in the tray 83 can be obtained from the center position 834*ac*. In this embodiment, the position of the tray 83 is detected as described above. Therefore, parts precision fluctuation and the state of the tray are less likely to cause misalignment in positioning a CD to the recording (printing) position than in the case where detection of the tray position is not included and the positioning is solely dependent of mechanical precision.

Figure 15D:
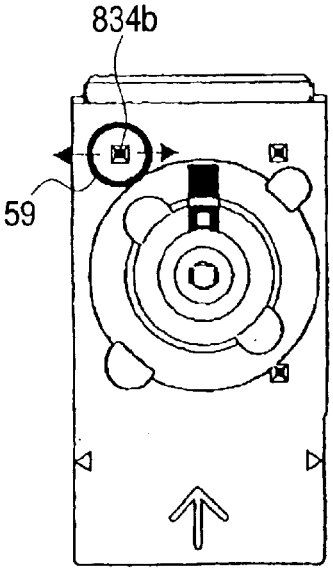
Figure 15E:
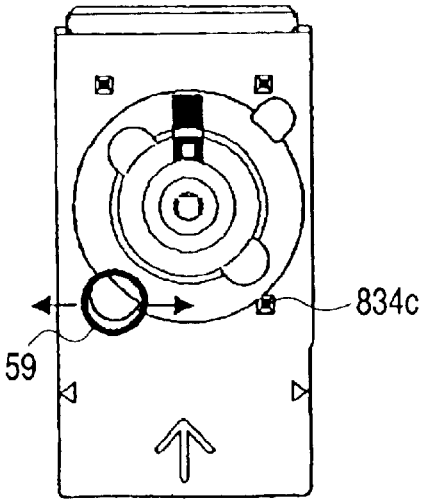

After detecting the position of the position detection mark 834*a* (the central position 834*ac*) of the tray 83, the carriage 50 is moved to detect the position detection mark 834*b* as shown in FIG. 15D. The left and right edges of the position detection mark 834*b* are detected to confirm that the previous detection of the position detection mark 834*a* is correct. This is because the moving operation to detect the position detection mark 834*b* makes it possible to prevent the position detection mark 834*c* from being mistaken as the position detection mark 834*a* when the tray 83 is accidentally inserted further than its regular set position and the position of the position detection mark 834*c* is detected as shown in FIG. 15E.

Figure 15F:
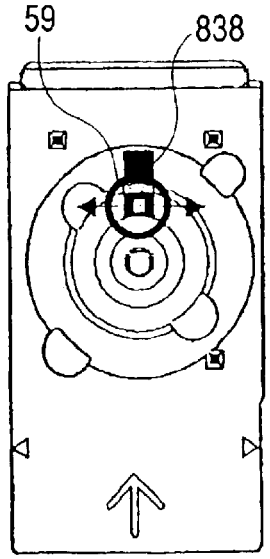

After the position of the tray 83 is detected, the tray 83 is transported in the tray 38 transporting direction until the position of the tray position detection sensor 59 of the carriage 50 coincides with the position of the media presence detection mark 838 (FIG. 13) of the tray 83 as shown in FIG. 15F. At this point, if the edge of the detection hole of the media presence detection mark 838 is detected and it matches the given hole width, it is judged that no CD is loaded and the recording operation (printing work) is interrupted. Then the tray 83 is sent to a given point to be discharged and an error message is displayed. On the other hand, if the media presence detection mark 838 is not detected, it is judged that a CD is loaded in the tray 83 and the recording operation is continued.

As the series of initial operations described above is finished, the tray 83 is transported to a given point in the back of the recording apparatus (printer or the like) where recording (printing) can be made on the entire surface of the CD. After that, recording (printing) is started using recording data which is sent from a host. A recorded image can be reduced in band unevenness, which is due to lack of accuracy in transporting the CD and in landing ink from the head 7, by employing multi-path recording in which an image is formed through several scans.

After the recording (printing) is finished, the tray 83 is transported back to the position where the operator has set the tray 83 in the tray guide 82 prior to the printing. Now the operator can take out the tray 83 loaded with the CD on which an image has been printed. Then the slide cover 81 is pulled and moved away from the main body of the recording apparatus to unlock the arm 85 from the spur holder 43 and unhook the hook 84 from the lower case 99. The CD transporting unit 8 is thus detached from the main body of the recording apparatus. Recording (printing) can be made on a CD accurately with a simple manipulation by the structure and operation (action) of the recording apparatus (image forming apparatus) described above.

Figure 20A:
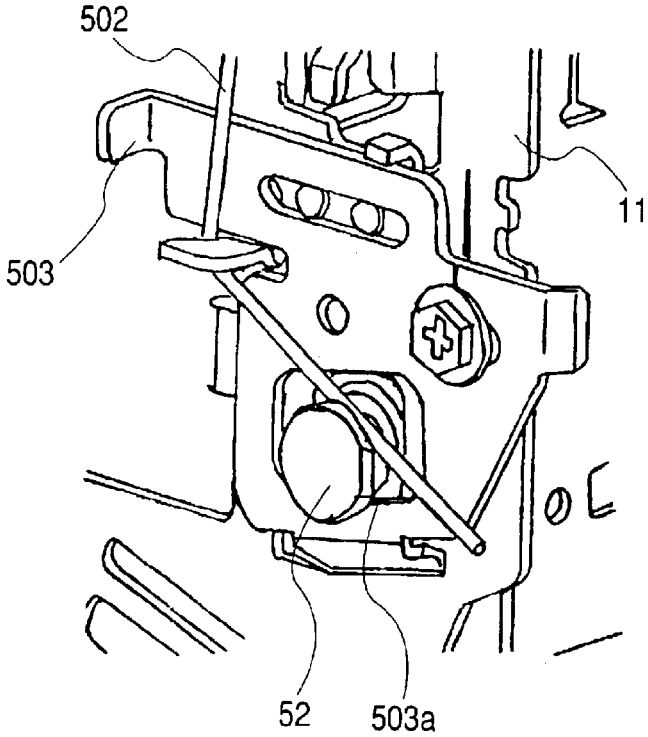
FIG. 20A is a partial perspective view showing a general supported-state on the left side of the guide shaft of the guide shaft lifting and lowering means in the recording apparatus to which the present invention is applied.
Figure 20B:
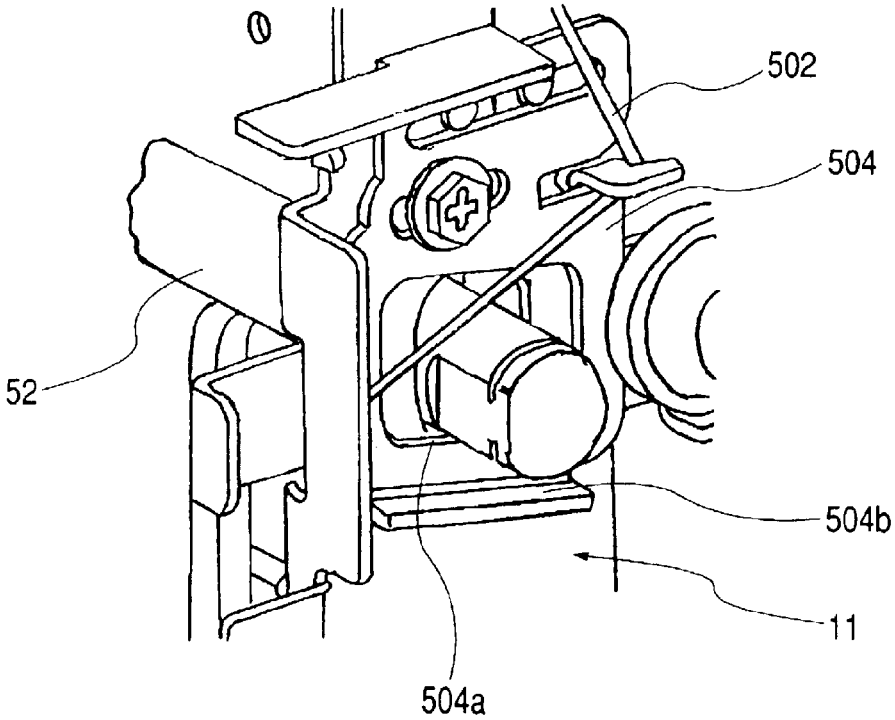
FIG. 20B is a partial perspective view showing a general supported-state on the right side of the guide shaft.
Figure 21A:
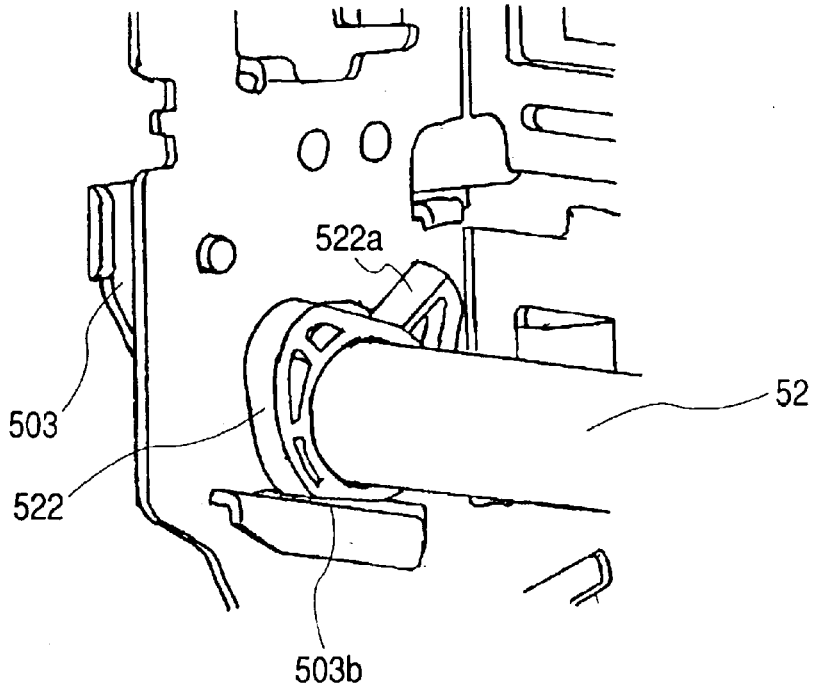
FIG. 21A is a partial perspective view showing a state of attachment of the eccentric cam in the general supported-state on the left side of the guide shaft of the guide shaft lifting and lowering means for lifting and lowering the guide shaft in the recording apparatus to which the present invention is applied.
Figure 21B:
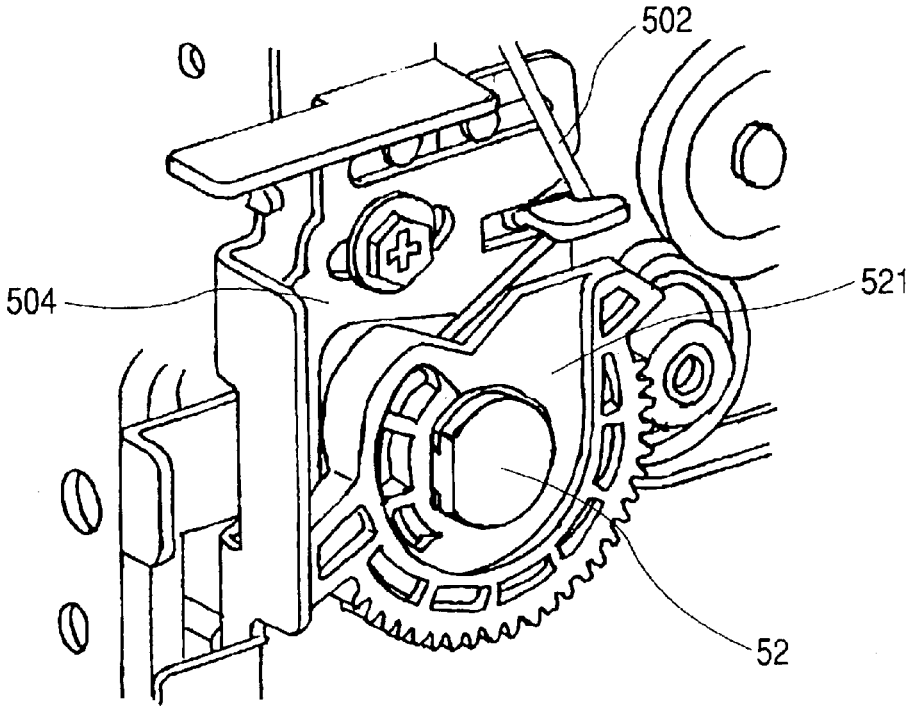
FIG. 21B is a partial perspective view showing a state of attachment of the eccentric cam in the general supported-state on the right side of the guide shaft.
Figure 22:
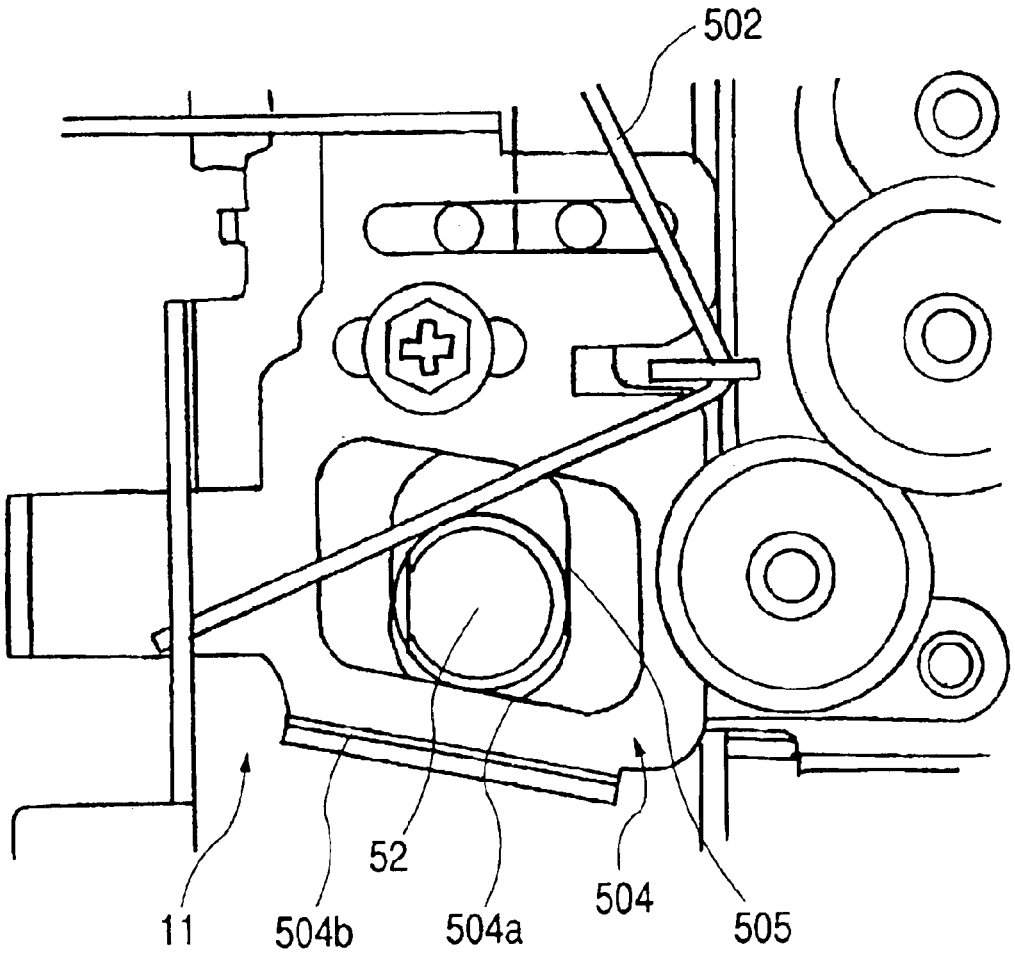
FIG. 22 is a partial perspective view showing a general supported-state of the guide shaft of the guide shaft lifting and lowering means in the recording apparatus to which the present invention is applied on the right side.
Figure 23A:
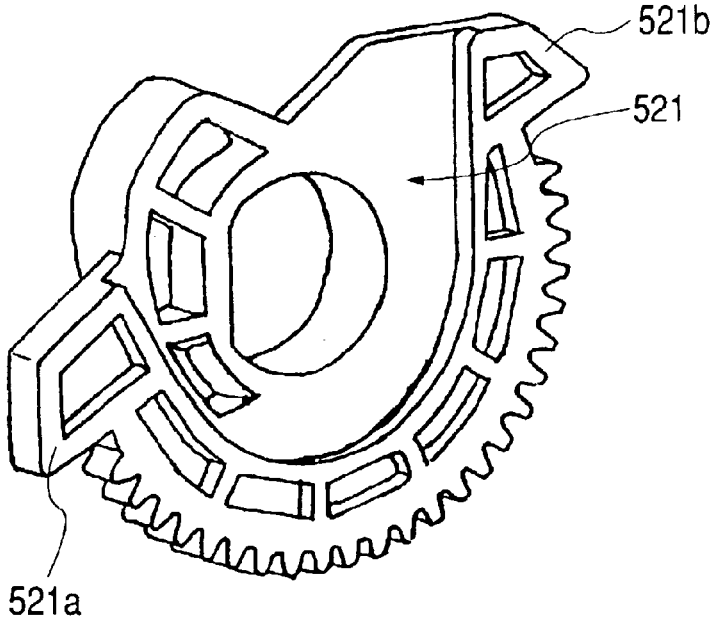
FIGS. 23A and 23B are perspective views schematically showing the eccentric cams of the guide shaft lifting and lowering means of the recording apparatus to which the present invention is applied as views from the inside and the outside, respectively.
Figure 23B:
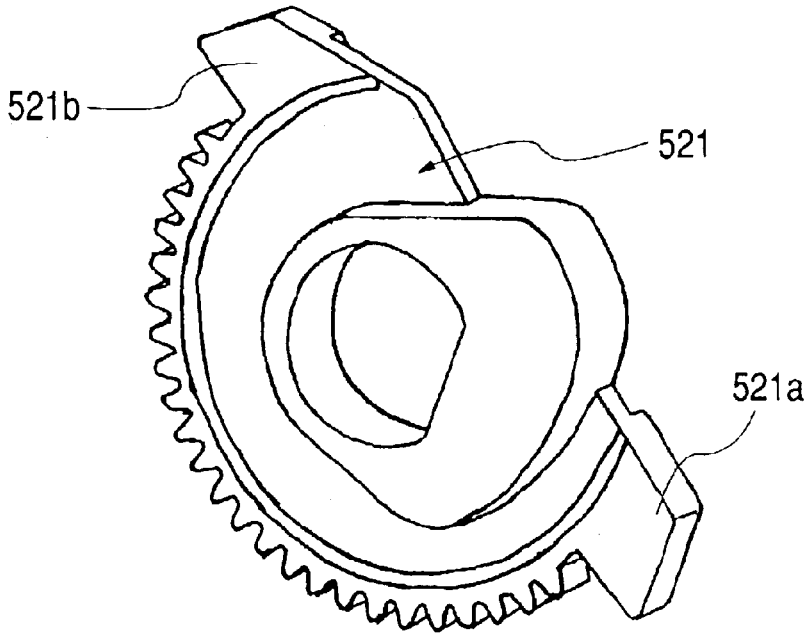

FIGS. 20A and 21A are partial perspective views showing how the eccentric cam is attached to the guide shaft 52 in a general supported-state of the guide shaft lifting and lowering means for lifting and lowering the guide shaft 52 in the recording apparatus to which the present invention is applied on the left side. FIGS. 20B and 22 are partial perspective views showing the general supported-state of the guide shaft 52 of the guide shaft lifting and lowering means in the recording apparatus to which the present invention is applied on the right side. FIG. 21B is a partial perspective view showing how the eccentric cam is attached to the guide shaft in the general supported-state of the guide shaft lifting and lowering means in the recording apparatus to which the present invention is applied on the right side. FIGS. 23A and 23B are perspective views schematically showing the eccentric cams 521 of the guide shaft lifting and lowering means of the recording apparatus to which the present invention is applied as views from both sides.

Next, a description will be given of Embodiment 1 of the guide shaft lifting and lowering means for lifting and lowering the guide shaft 52 in the recording apparatus to which the present invention is applied. In FIGS. 20A to 22, positioning is performed by the gap adjustment member L (inter-sheet gap adjustment plate L) 503 and the gap adjustment member R (inter-sheet gap adjustment plate R) 504 regarding a position in height of the guide shaft 52 (position in height of the carriage 50 for regulating the gap between the recording head 7 and the sheet material or the CD as the recording material) upon the general recording (general printing). Also, the position of the guide shaft 52 in the recording material transporting direction is aligned by biasing the guide shaft 52 toward the vertical surface 505 of a chassis 11 constituting an outline form of the recording apparatus by means of a guide shaft spring 502. Therefore, even if the height of the guide shaft 52 is changed, the position thereof in the recording material transporting direction is not changed but is always aligned at a given position with accuracy by the vertical surface 505 of the chassis 11 constituting the outline form of the recording apparatus.

Note that, a guide shaft (lower surface) support portion 503*a* of the inter-sheet gap adjustment plate L (gap adjustment member L) 503 and a guide shaft (lower surface) support portion 504*a* of the inter-sheet gap adjustment plate R (gap adjustment member R) 504 each constitute a slope. By sliding the inter-sheet gap adjustment plate L 503 and the inter-sheet gap adjustment plate R 504 to and fro, the position of the guide shaft 52 upon the general recording (general printing position in height, lowest position in height, or initial position in height) can be finely adjusted. Further, in addition to the inter-sheet gap adjustment plate L 503 and the inter-sheet gap adjustment plate R 504, eccentric cam abutment portions (cam abutment surfaces) 503*b* and 504*b* in parallel to the guide shaft support portions 503*a* and 504*a* are provided. At the right-hand end of the guide shaft 52, the eccentric cam R 521 is disposed which includes the cam face and the gear portion. The driving force (rotational force) of the carriage lifting motor 58 is transmitted to the gear portion through a gear train.

In other words, the carriage lifting motor 58 is adapted to control the rotation position of the eccentric cam R 521, so that the position in height of the guide shaft 52 (sheet gap specified by the relation of the recording head 7 to the recording material) can be adjusted. In addition, the eccentric cam L 522 is provided in a position inside the chassis 11 at the left end of the guide shaft 52. The eccentric cam L 522 is provided with a rotation regulating portion L 522*a* for regulating the rotation of the eccentric cam L 522 while abutting against the carriage 50.

Figure 24A:
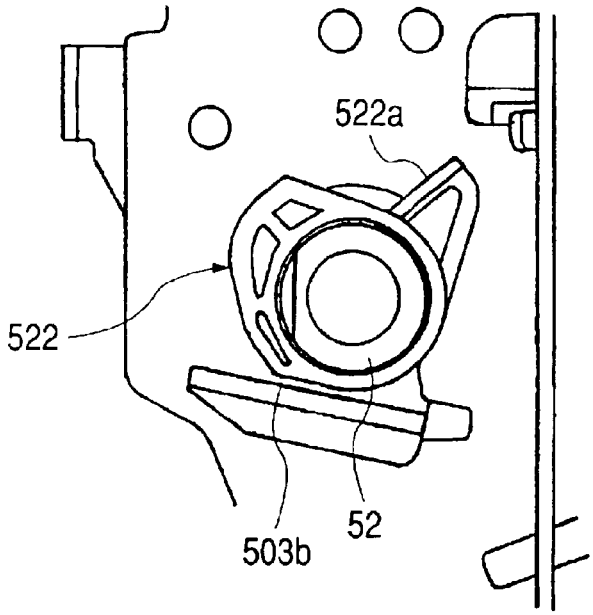
FIG. 24A is a side view schematically showing a position in height of an eccentric cam L at the time of general recording (general print height)
Figure 24B:
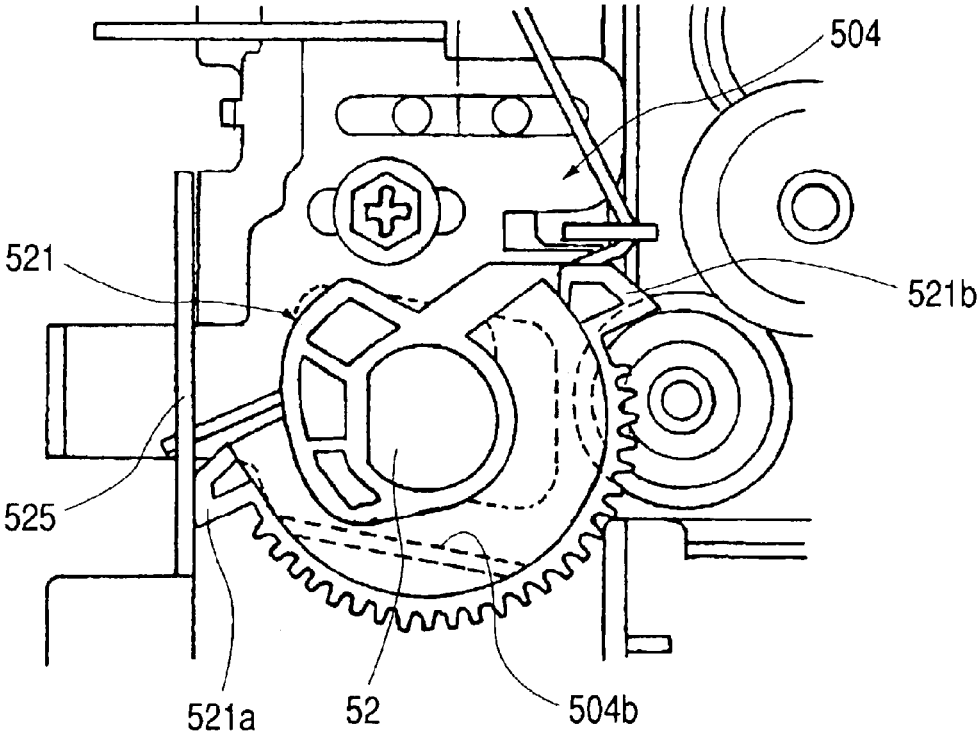
FIG. 24B is a side view schematically showing a position in height of an eccentric cam R at the time of general recording (general print height)
Figure 25A:
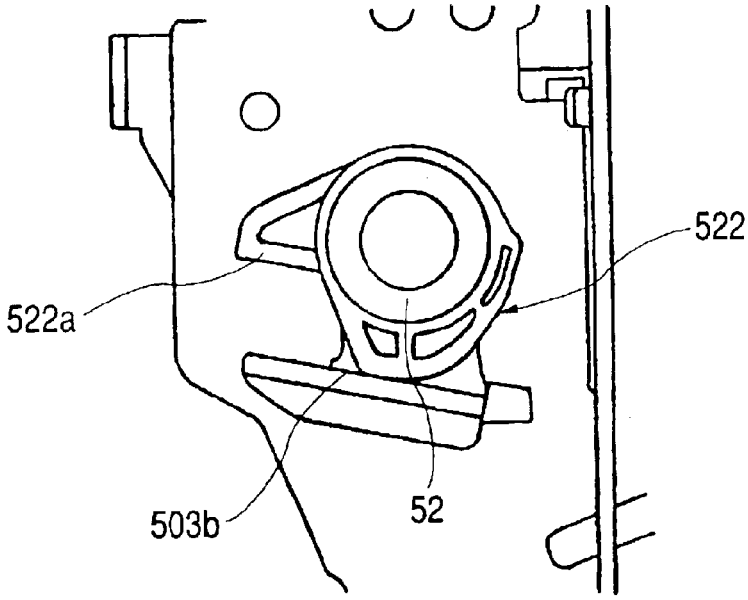
FIG. 25A is a side view schematically showing the position in height of the eccentric cam L at the time of CD printing (CD print height)
Figure 25B:
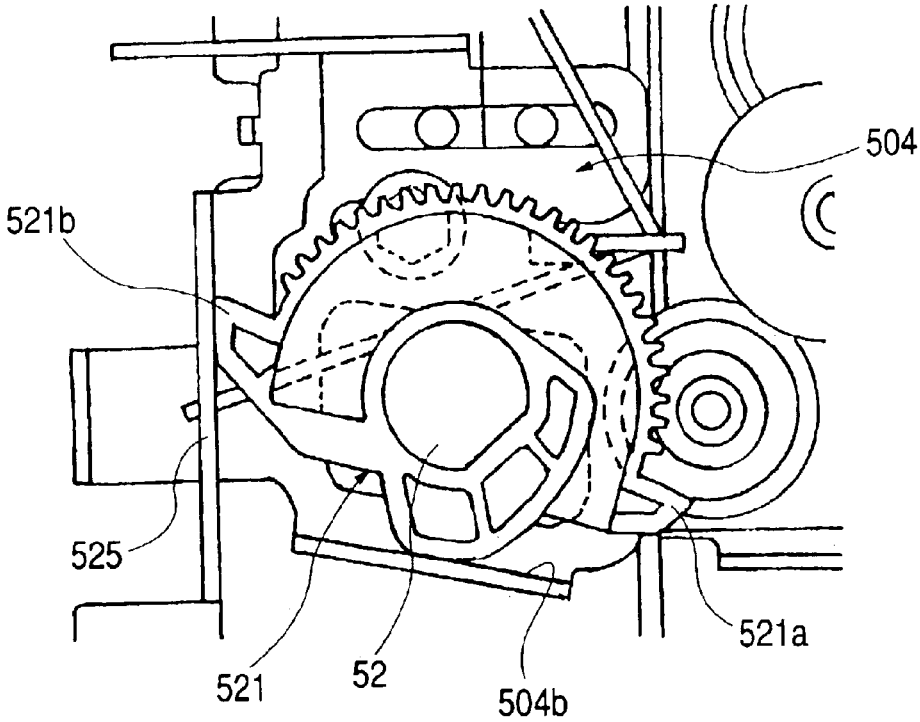
FIG. 25B is a side view schematically showing the position in height of the eccentric cam R at the time of CD printing (CD print height)

FIG. 24A is a side view schematically showing a position in height of the eccentric cam L 522 upon general recording (general print height) and FIG. 24B is a side view schematically showing a position in height of the eccentric cam R 521 upon general recording (general print height). FIG. 25A is a side view schematically showing the position in height of the eccentric cam L 522 at the time of CD printing (CD print height) and FIG. 25B is a side view schematically showing the position in height of the eccentric cam R 521 at the time of CD printing (CD print height). At the positions in height upon general recording (general printing position in height, lowest position in height, and initial position in height), the cam faces of both the eccentric cam L 522 and the eccentric cam R 521 are not brought into contact with the eccentric cam abutment portions 503*b* and 504*b* of the gap adjustment member L (inter-sheet gap adjustment plate L) 503 and the gap adjustment member R (inter-sheet gap adjustment plate R) 504, respectively. The guide shaft 52 (lower surface thereof) is supported at both end portions by the guide shaft support portions 503*a* and 504*a* as the portions for regulating the lowest position in height, thereby positioning the guide shaft 52 in the height direction. Further, the rotation position of the eccentric cam R 521 is aligned by causing the rotation regulating portion 521*a* to abut against the chassis abutment portion 525 (see FIG. 24B) of the chassis 11.

Next, the case where recording on the CD is made will be described. As shown in FIGS. 24A and 24B, the guide shaft 52 is rotated in a state of being located at the position in height upon the general recording (general printing position in height; lowest position in height or initial position in height in this embodiment) by applying a current to the carriage lifting motor 58 as a DC motor for a predetermined time period. Thus, the eccentric cam R 521 is rotated counterclockwise as viewed from the right-side surface (FIG. 24B). The cam faces of the eccentric cams R and L abut against the cam abutment portions (cam abutment surfaces) 503*b* and 504*b* of the gap adjustment members L and R (inter-sheet gap adjustment plates L and R) 503 and 504 to thereby gradually shift the position in height of the guide shaft 52 to the upper position. After that, as shown in FIG. 25B, the rotation regulating portion 521*b* of the eccentric cam R 521 is abutted against the chassis abutment portion 525, thereby aligning the rotation position of the eccentric cam R 521.

As a result, the eccentric cam L 522 is put into a state shown in FIG. 25A, whereas the eccentric cam R 521 is put into a state shown in FIG. 25B. That is, the guide shaft 52 (carriage 50 and recording head 7) is moved to the CD printing position in height (position at which an optimum distance between the sheets is obtained for recording on the CD). Therefore, an appropriate gap for recording on the CD on the tray 83 can be formed. At this time, the position of the guide shaft 52 in the recording material transporting direction is aligned at any given position by the vertical surface 505 (FIG. 22) of the chassis 11. Thus, even if the guide shaft 52 moves from the general printing position in height (in this embodiment, the lowest position in height or initial position in height) up to the CD printing position in height, the position of the guide shaft 52 in the recording material transporting direction is not changed but is kept in the state defined by positioning by the chassis 11.

When the guide shaft 52 is returned to the general printing position in height (in this embodiment, the lowest position in height or initial position in height) after the completion of recording on the CD, a current is applied for a predetermined period of time to the carriage lifting motor 58 for rotation at the CD printing position in height. Therefore, the eccentric cam R 521 is rotated clockwise as viewed from the right side surface in FIG. 25B. Here, the eccentric cam R 521 and the eccentric cam L 522 are fixed to both ends of the guide shaft 52 in the rotating direction as described above. Consequently, in synchronization with the clockwise rotation of the eccentric cam R 521, the guide shaft 52 and the eccentric cam L 522 are similarly rotated clockwise. Then, the cam faces of the eccentric cams R and L begin to descend along the cam abutment portions (cam abutment surfaces) 503*b* and 504*b* of the inter-sheet gap adjustment plates L and R (the distance between the center of the guide shaft 52 and the cam abutment portions 503*b* and 504*b* of the inter-sheet gap adjustment plates L and R begins to decrease). The position in height of the guide shaft 52 thus begins to lower. After that, as shown in FIG. 24B, the rotation regulating portion 521*a* of the eccentric cam R 521 abuts against the chassis abutment portion 525 again, so that the rotation position of the eccentric cam R 521 is aligned to return the guide shaft 52 to the general printing position in height (position shown in FIGS. 24A and 24B; in this embodiment, the lowest position in height).

Figure 26A:
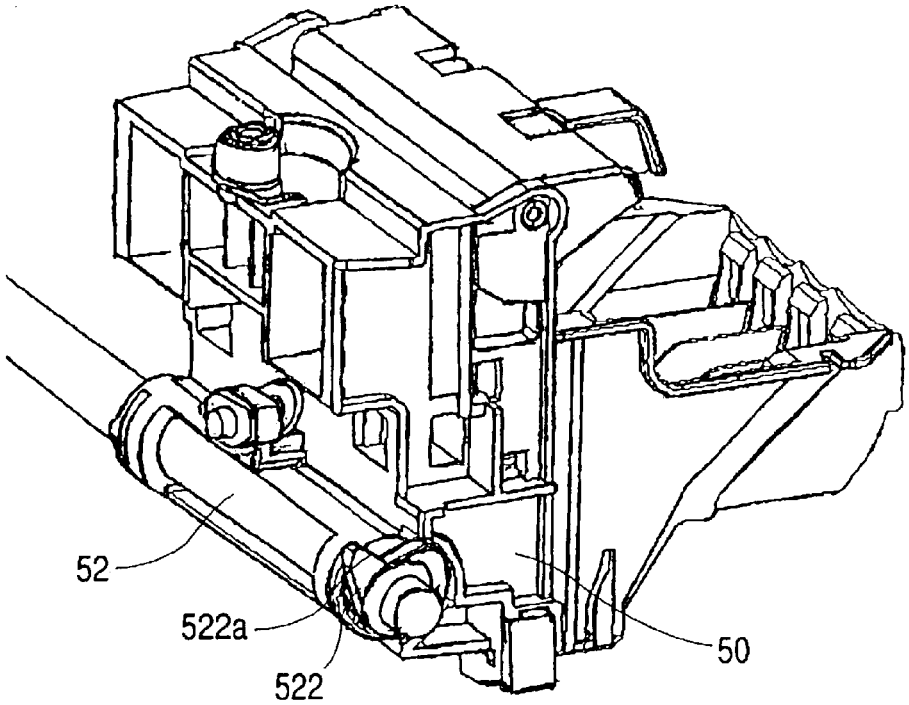
FIGS. 26A and 26B are perspective views showing how the carriage is utilized to rotate the eccentric cam L from the general printing position in height (FIG. 26A) to a cardboard printing position in height (FIG. 26B) in the recording apparatus to which the present invention is applied.
Figure 26B:
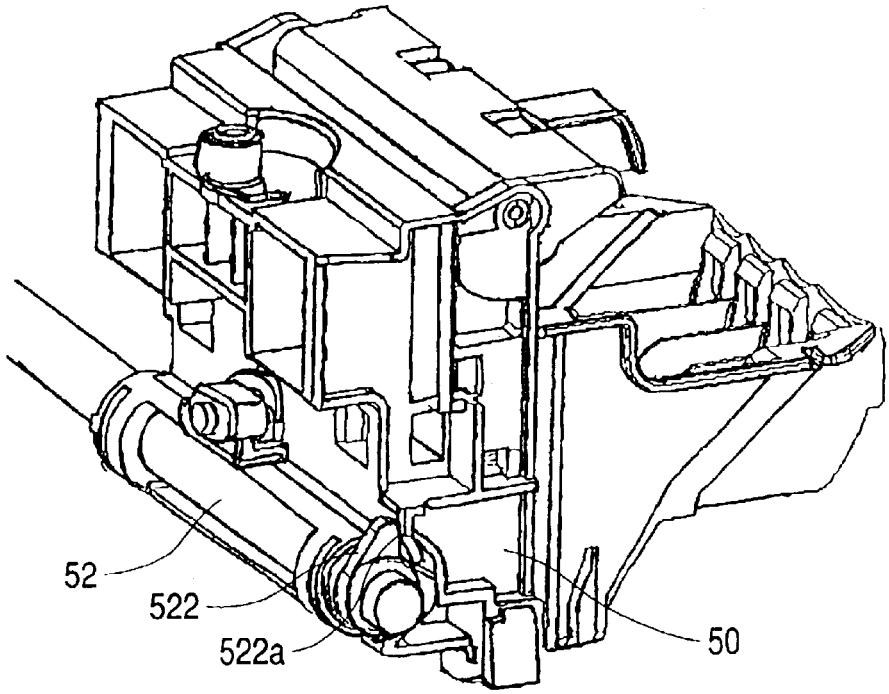
Figure 27A:
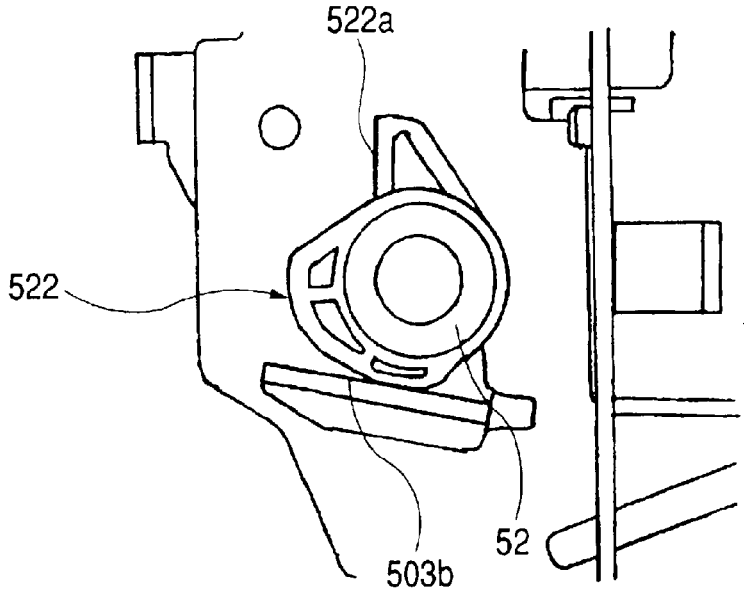
FIG. 27A is a side view schematically showing a position in height of the eccentric cam L at the time of cardboard printing (cardboard print height)
Figure 27B:
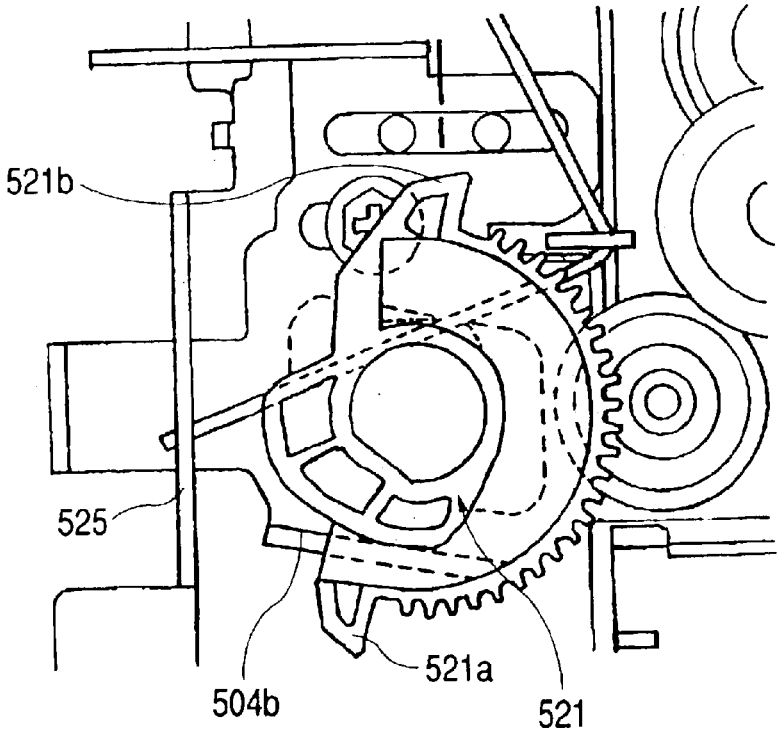
FIG. 27B is a side view schematically showing a position in height of the eccentric cam R at the time of cardboard printing (cardboard print height)

FIGS. 26A and 26B are perspective views showing how the carriage is utilized to rotate the eccentric cam L from the general printing position in height (FIG. 26A) to the cardboard printing position in height (FIG. 26B) in the recording apparatus to which the present invention is applied. FIG. 27A is a side view schematically showing a position in height of the eccentric cam L 522 at the time of cardboard printing (cardboard print height) and FIG. 27B is a side view schematically showing a position in height of the eccentric cam R 521 at the time of cardboard printing (cardboard print height). Next, a description will be give of a case where the carriage 50 (guide shaft 52) is lifted from the general printing position in height (in this embodiment, the lowest position in height) to the cardboard printing position in height lower than the CD printing position in height.

First, the carriage 50 is set in the general printing position in height as shown in FIGS. 24A and 24B. Thereafter, as shown in FIGS. 26A and 26B, the carriage 50 is moved to a changeover position in the vicinity of the eccentric cam L 522 at the left-hand end of the guide shaft 52. At this position, the current is applied for a predetermined period of time to the carriage lifting motor 58 to rotate the motor 58. As a result, the eccentric cam R 521 is rotated counterclockwise as viewed from the right side surface of FIG. 24B. Then, the eccentric cam L 522 is rotated in the same direction together with the guide shaft 52; the eccentric cam is rotated from the state of FIG. 26A to the state of FIG. 26B, so that the rotation regulating portion L 522*a* of the eccentric cam L 522 abuts against the carriage 50.

Figure 32A:
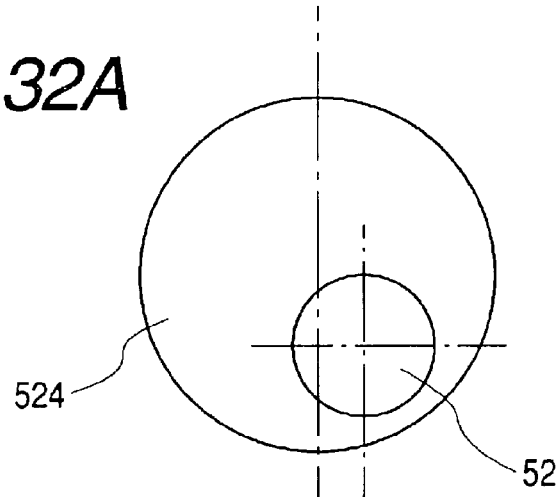
FIGS. 32A, 32B, and 32C are explanatory views showing an eccentric cam and a guide shaft of a conventional recording apparatus.
Figure 32B:
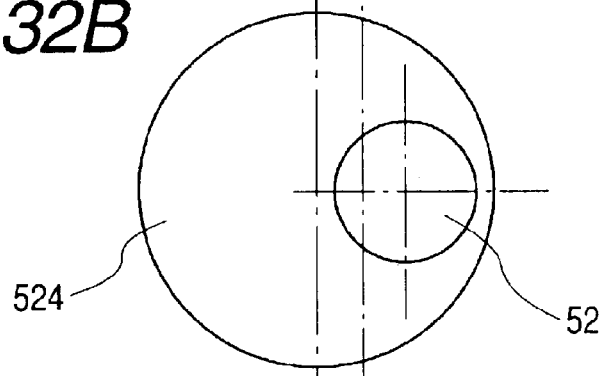
Figure 32C:
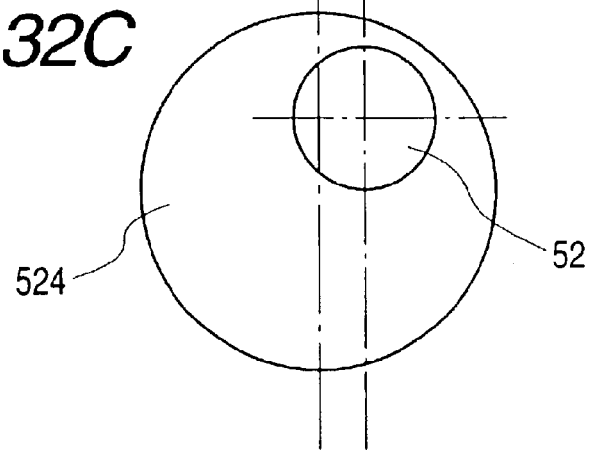

With this operation, the eccentric cam L 522 undergoes positioning so as to be in a state of FIG. 27A (intermediate state between the positions of FIG. 24A and FIG. 25A). The eccentric cam R 521 undergoes positioning so as to be in a state of FIG. 27B (intermediate state between the positions of FIG. 24B and FIG. 25B). In this way, the carriage 50 (guide shaft 52) can be lifted to the cardboard printing position in height lower than the CD printing position in height. At this time, unlike the conventional cases as shown in FIGS. 32A, 32B, and 32C, the position of the guide shaft 52 in the recording material transporting direction is aligned to the given position by the vertical surface 505 of the chassis 11 (FIG. 22). Thus, even if the guide shaft 52 is lifted from the general print height to the cardboard print height lower than the CD print height, the position of the guide shaft 52 in the recording material transporting direction is not changed but is kept in the state defined by positioning by the chassis 11.

According to the guide shaft lifting and lowering means (guide shaft lifting and lowering means according to this embodiment) for lifting and lowering the guide shaft 52 as mentioned above, positioning can be made on the guide shaft 52 at three different positions in height inclusive of the general print height, the cardboard print height, and the CD print height. Those positions in height can be selected accurately in an automatic fashion without any operation by the user, such that the gap between the recording head 7 and the recording material is set as the optimum value by use of the information on the recording material of recording data sent from a host. With the structure of the embodiment described above, unlike the conventional cases shown in FIGS. 32A to 32C, without changing the position of the guide shaft 52 in the recording material transporting direction, the position of the guide shaft 52 can be changed to the three positions in height, i.e., the general print height, the cardboard print height, and the CD print height. Therefore, whichever position in height is selected, the control for changing the recording start position to the recording material is by no means required and the high-quality recording can be made at the accurate position on the recording material.

Further, the vertical surface 505 (FIG. 22) of the chassis 11 performs positioning on the guide shaft 52 in the recording material transporting direction at any position in height. Accordingly, as compared with the conventional cases shown in FIGS. 32A to 32C, in which the guide shaft undergoes positioning to the chassis through the eccentric cam 524, the parallelism between the transport roller 36 and the guide shaft 52 in the direction vertical to the recording material transporting direction can be increased to some extent corresponding to the dispensable part tolerance of the eccentric cam 524 etc., the tolerance being involved in the conventional cases. As a result, the deterioration of the perpendicularity between the carriage scanning direction and the recording material transporting direction can be avoided. The quality of recording on the, recording material can be accordingly improved. Also, the operation for lifting and lowering the guide shaft 52 to the three different positions in height can be performed automatically without any operation by the user.

In addition, according to the embodiment as described above, regarding the control on the position in height of the guide shaft 52, the positional detection using the sensor etc. is not performed. That is, as for the general print height and the CD print height, the control is performed by the abutment of the eccentric cam R 521 and the chassis abutment portion 525. Further, as for the cardboard print height, the control is performed by the abutment of the eccentric cam L 522 and the carriage 50. Thus, the control on the position in height of the guide shaft 52 can be achieved with a simple and low-cost structure rather than the case of using the sensor or the like. As a result, the effects of lowering the costs can be expected more than the case of using the sensor or the like. Further, according to the embodiment as described above, the inter-sheet gap adjustment plate L (gap adjustment member L) 503 and the inter-sheet gap adjustment plate R (gap adjustment member R) 504 are parallel to the slope of the guide shaft support portions 503*a* and 504*a* and the eccentric cam abutment portions (surfaces) 503*b* and 504*b*. Thus, even if the general print height of the guide shaft 52 is finely adjusted by the above inter-sheet gap adjustment plate, the variation from the general print height to either the cardboard print height or the CD print height can be set as the accurate value involving no error. Consequently, whichever position the guide shaft 52 is located at, the optimum gap with the recording material can be defined, thereby increasing the recording quality.

Also, at the general printing position in height for which the highest image quality is required, the guide shaft 52 abuts against the inter-sheet gap adjustment plate 504 to undergo the regulation on the position in height irrespective of the eccentric cam 521. Thus, the guide shaft is free of influence of the change with time of the eccentric cam 521 and thus, the optimum gap (gap between the sheets) with the recording material can be defined. Further, the position of the guide shaft 52 can be changed to the three positions in height, i.e., the general print height, the cardboard print height, and the CD print height without changing its direction in the recording material transporting direction. As a result, the control for changing the recording start position to the recording material is unnecessary. In addition, the vertical surface 505 of the chassis 11 performs positioning on the guide shaft 52 in the recording material transporting direction at any position in height. Therefore, the parallelism between the transport roller 36 and the guide shaft 52 can be increased to some extent corresponding to the dispensable part tolerance of the eccentric cam 524, the tolerance being involved in the conventional cases where the guide shaft undergoes positioning to the chassis through the eccentric cam 524. As a result, the deterioration of the perpendicularity between the carriage scanning direction and the recording material transporting direction can be avoided. The quality of recording on the recording material can be further improved.

(Embodiment 2)

Figure 28:
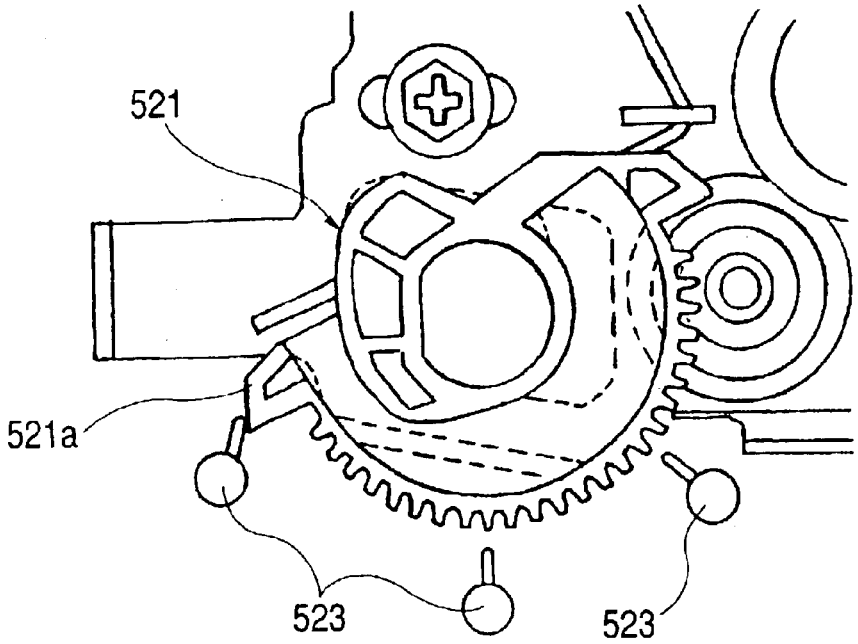
FIG. 28 is a side view schematically showing a state of guide shaft lifting and lowering means at the general print height in the recording apparatus to which the present invention is applied, according to Embodiment 2 of the present invention.
Figure 29:
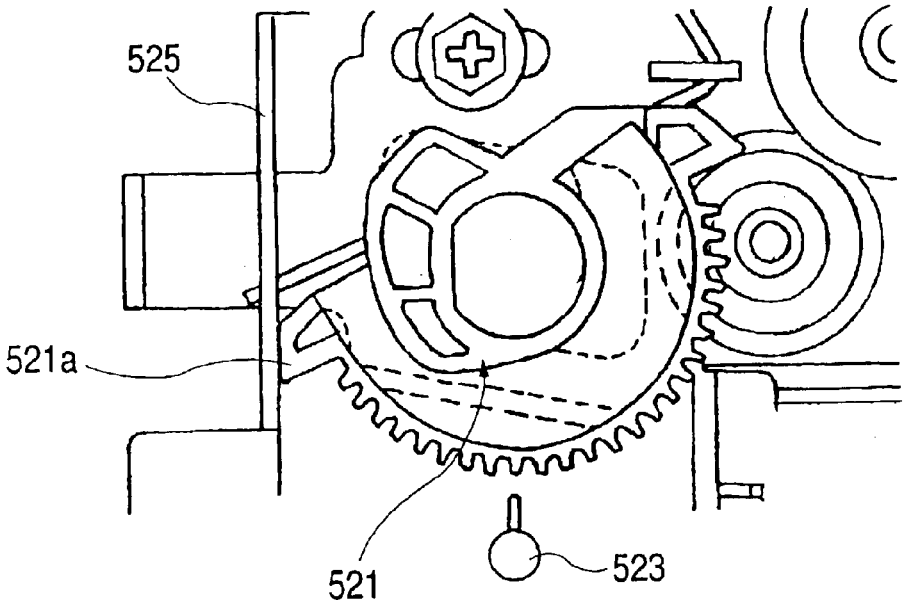
FIG. 29 is a side view schematically showing a modification as a partial modification of Embodiment 2 shown in FIG. 28.

FIG. 28 is a side view schematically showing a state of guide shaft lifting and lowering means at the general print height in the recording apparatus to which the present invention is applied, according to Embodiment 2 of the present invention. FIG. 29 is a side view schematically showing a modification as a partial modification of Embodiment 2 shown in FIG. 28. According to the structure of Embodiment 1 as described above, upon the control on the position in height of the guide shaft 52, the positional detection using the sensor etc. is not performed. That is, as for the general print height and the CD print height, the control is performed by the abutment of the eccentric cam R 521 and the chassis abutment portion 525. Further, as for the cardboard print height, the control is performed by the abutment of the eccentric cam L 522 and the carriage 50. On the contrary, according to the structure of Embodiment 2 shown in FIG. 28, instead of the positional detection utilizing the abutment of the eccentric cam L 522 and the eccentric cam R 521, the rotation position of the eccentric cam R 521 is detected using the three cam rotation position sensors 523. Embodiment 2 shown in FIG. 28 differs from Embodiment 1 shown in FIG. 1 to FIG. 27B only in this point but has substantially the same structure as in Embodiment 1 except for the above point.

With the structure as in Embodiment 2 shown in FIG. 28, in addition to the effects attained according to Embodiment 1 above, i.e., the effect of eliminating the control for changing the recording start position to the recording material and the effects of avoiding the deterioration of the perpendicularity between the carriage scanning direction and the recording material transporting direction and of increasing the recording quality, the following effect can be obtained. That is, when lifting the carriage 50 to the cardboard print height as the midpoint, the carriage 50 can be lifted thereto without moving to the changeover position (FIGS. 26A and 26B) in the vicinity of the end of the guide shaft 52. As a result, the lifting and lowering operation of the guide shaft 52 can be made while keeping the carriage 50 in the same position, thereby making it possible to omit the unnecessary movement of the carriage 50.

Also, as shown in FIG. 29 as a partial modification of Embodiment 2, the control on the position in height of the guide shaft 52 can be made utilizing the abutment of the eccentric cam R 521 and the abutment portion 525 of the chassis 11 as for the general print height and the CD print height as in Embodiment 1 above. Then, only the cardboard printing position in height may be detected using the cam rotation position sensor 523. With this structure, in addition to the effects of Embodiment 1 above, the following effects can be obtained. That is, since the control on the lifting and lowering operation of the guide shaft 52 can be performed while keeping the carriage 50 in the same position, not only can the unnecessary movement of the carriage 50 be eliminated, but also the cost can be lowered because of the reduced number of cam rotation position sensors 523 to be used.

(Embodiment 3)

Figure 30:
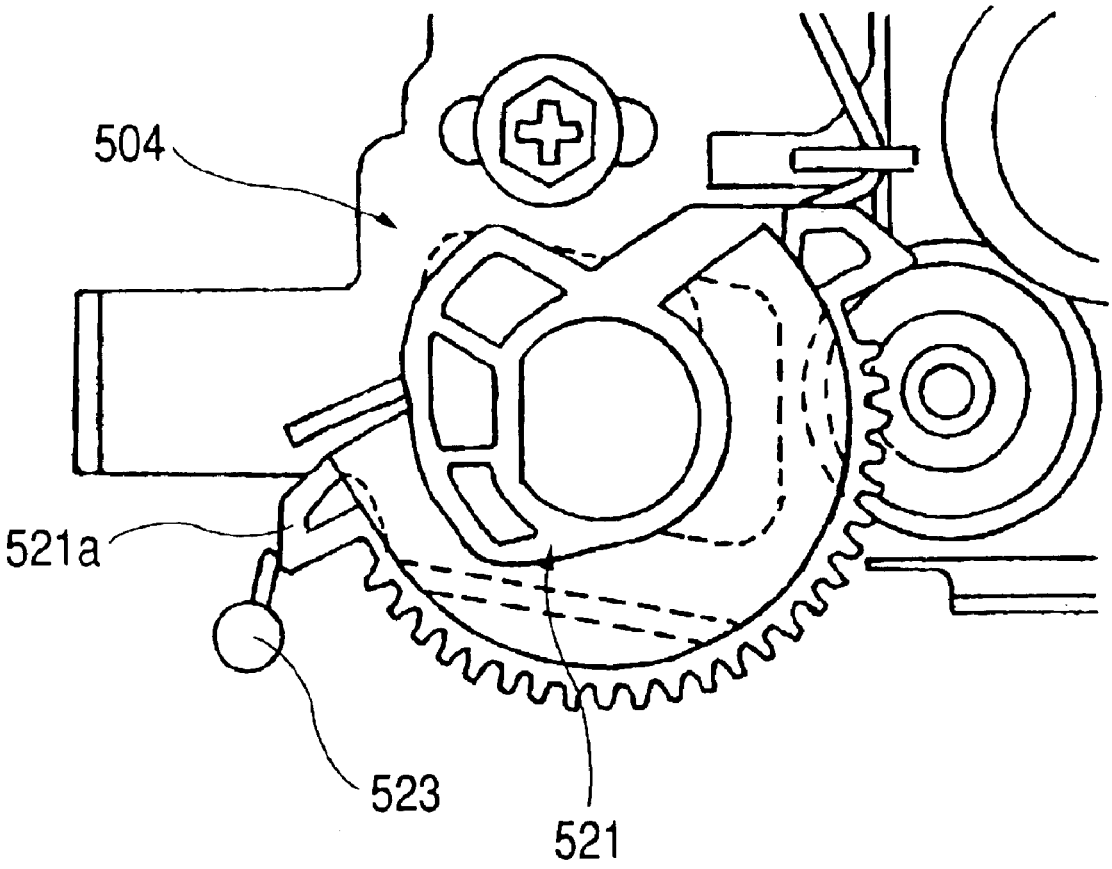
FIG. 30 is a side view schematically showing a state of guide shaft lifting and lowering means at the general print height in the recording apparatus to which the present invention is applied, according to Embodiment 3 of the present invention.

FIG. 30 is a side view schematically showing a state of guide shaft lifting and lowering means at the general print height in the recording apparatus to which the present invention is applied, according to Embodiment 3 of the present invention. According to Embodiment 3 shown in FIG. 30, the general printing position in height of the guide shaft 52 is detected by the cam rotation position sensor 523 and at the same time, the pulse motor is used as the carriage lifting motor 58. Embodiment 3 shown in FIG. 30 differs from Embodiment 1 or 2 above in this point but has substantially the same structure except for this point. According to Embodiment 3 shown in FIG. 30, the control on the position in height of the guide shaft 52 after the detection of the general print height can be made in such a way as to change position of the guide shaft to any position in height according to the pulse frequency applied to the carriage lifting motor 58 as the pulse motor. Also, the control on the position in height of the guide shaft 52 can be readily made with accuracy through positioning control at the plural stages, i.e., three or more stages. As a result, in addition to the effects achieved according to Embodiment 2 above, the gap appropriate for the recording materials with different thicknesses (distance between the recording head 7 and the recording material) can be easily secured with accuracy and hence, the recording apparatus capable of further increasing the recording quality with efficiency can be obtained.

(Embodiment 4)

Figure 31:
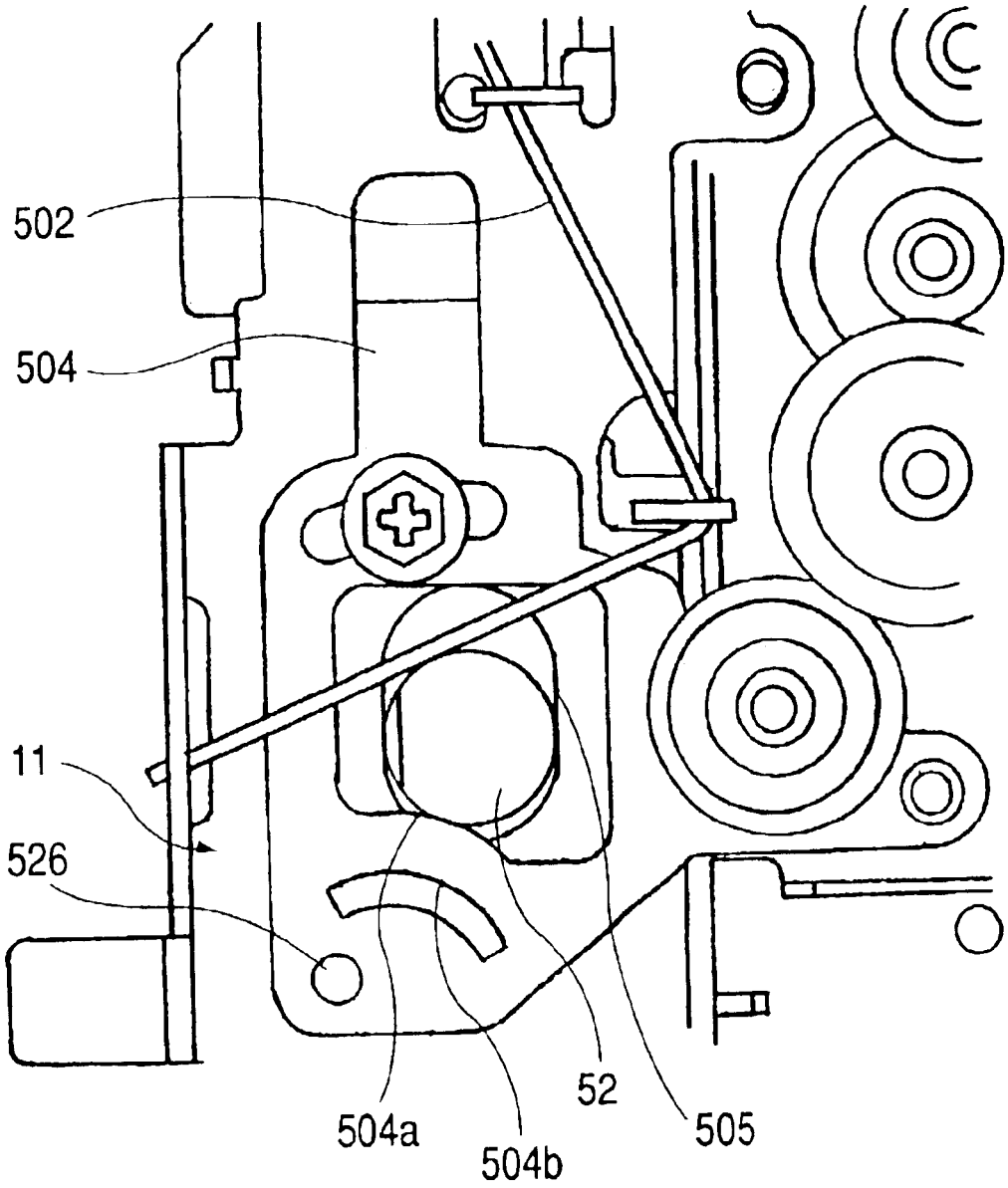
FIG. 31 is a schematic side view showing an inter-sheet gap adjustment plate as a gap adjustment member in guide shaft lifting and lowering means in the recording apparatus to which the present invention is applied, according to Embodiment 4 of the present invention.

FIG. 31 is a schematic side view showing an inter-sheet gap adjustment plate as a gap adjustment member in guide shaft lifting and lowering means in the recording apparatus to which the present invention is applied, according to Embodiment 4 of the present invention. In Embodiment 1 above, the guide shaft support portions 503*a* and 504*a* constitute linear slopes. The eccentric cam abutment portions 503*b* and 504*b* include planes parallel to the guide shaft support portions. By sliding the inter-sheet gap adjustment plate L 503 and the inter-sheet gap adjustment plate R 504 to and fro, the guide shaft 52 undergoes the fine adjustment of the general printing position in height. According to the structure of Embodiment 1 above, in which the fine adjustment is made by sliding the inter-sheet gap adjustment plate to and fro, the operability is not so high, thereby causing such a defect that the operator hardly performs the fine adjustment.

To cope with this, according to Embodiment 4 shown in FIG. 31, the guide shaft support position 504*a* of the inter-sheet gap adjustment plate 504 is formed in an arc shape and the inter-sheet gap adjustment plate 504 is rotated to thereby finely adjust the position in height of the guide shaft 52 at the general print height. In this case, the eccentric cam abutment surface (eccentric cam abutment portion) 504*b* also takes the arc shape. At this time, from the positional relation therebetween, even if the inter-sheet gap adjustment plate 504 is rotated, the distance between the guide shaft support portion 504*a* and the eccentric cam abutment portion 504*b* is not changed. The other structures of Embodiment 4 shown in FIG. 31 are substantially the same as in Embodiment 1 above. The corresponding components are denoted by the same reference numerals and a detailed description thereof will be omitted. With such a structure, the inter-sheet gap adjustment plate 504 is rotated, which makes it possible to finely adjust the general printing position in height of the guide shaft 52 (in each embodiment, the initial position in height or the lowest position in height). Therefore, in addition to the effects of Embodiment 1 above, the operability at the time of adjustment on the general printing position in height is improved, which provides an advantage in that the operator can easily perform fine adjustment.

According to the above embodiments, without changing the position of the guide shaft 52 in the recording material transporting direction, the guide shaft 52 can be lifted to the three or more positions in height inclusive of general print height, cardboard print height, and CD print height. Accordingly, even if the control for changing the recording start position to the recording material such as CD or sheet material is omitted, the high-quality recording can be easily performed at the accurate position on the recording material. Further, whichever position in height the guide shaft 52 is located at, its position in the recording material transporting direction is aligned (positional regulation) by the vertical surface 505 of the chassis 11. Consequently, the parallelism between the transport roller 36 and the guide shaft 52 is increased to some extent corresponding to the dispensable part tolerance of the eccentric cam, the tolerance being involved in the conventional cases where the guide shaft undergoes positioning to the chassis through the eccentric cams. Therefore, the accuracy of the crossing angle (perpendicularity) between the carriage scanning direction and the recording material transporting direction can be made high, so that the quality of recording on the recording material can be increased.

Further, according to the recording data, the position in height of the guide shaft is set. Based on the setting of the position in height, the guide shaft is lifted and lowered and hence, it is possible to perform recording on the recording materials with different thicknesses with the appropriate gap (sheet gap) without any operation of the user. Also, the guide shaft can be lifted and lowered with the low-cost structure instead of the positional detection using the sensor or the like, thereby achieving the effects of lowering the costs. In addition, according to the recording data, the position in height of the guide shaft is set. Based on the above, the guide shaft is lifted and lowered and hence, it is possible to perform recording on the recording materials with different thicknesses with the appropriate gap without any operation of the user. Further, even if the initial position in height of the guide shaft is finely adjusted using the gap adjustment member (inter-sheet gap adjustment plate), the variation from the initial position in height to each of the plural printing positions in height can be set as the accurate value with no error. At any printing position in height of the guide shaft, the appropriate gap with the recording material can be defined to thereby improve the recording quality. At the same time, without changing the position of the guide shaft in the recording material transporting direction, the position of the guide shaft can be changed to the three or more positions in height. As a result, the control for changing the recording start position to the recording material can be made unnecessary.

Note that in the above embodiment, the case of using the ink-jet recording apparatus as the recording apparatus has been described by way of example. However, the present invention can be applied to the recording apparatus using another recording system, such as wire dot type one, thermal type one, or laser beam type one as well and can provide the similar operation and effect. Also, the present invention can be similarly applied to the recording apparatus for monochrome recording, the color recording apparatus for recording in plural different colors using one or more recording heads, or the gradation recording apparatus for recording with the same color but plural different densities or in addition, the recording apparatus as the combination thereof, and the same effects can be provided.

In addition, the present invention can be applied, in a similar manner, with similar effects, to an ink jet recording apparatus which uses liquid ink irrespective of arrangement of a recording head and an ink tank. Examples of the arrangement include one employing an exchangeable head cartridge in which a recording head and an ink tank are integrated, and one in which a recording head and an ink tank are separated from each other and are connected to each other by an ink supplying tube or the like. The present invention is also applicable to an ink jet recording apparatus whose recording means uses an electromechanical transducer such as a piezoelectric element, and provides particularly excellent effects when applied to an ink jet recording apparatus having recording means that utilizes heat energy to jet ink. This is because the recording method makes it possible to achieve recording of increased density and definition.

What is claimed is:

1. A recording apparatus for recording on a recording material by recording means, said recording apparatus comprising:

a main body, having a chassis;

a carriage for carrying the recording means moving in a direction crossing a recording material transporting direction;

a guide shaft for guiding a movement of said carriage;

a cam provided on said guide shaft; and an adjustment member, provided on said chassis of said main body of the apparatus, for changing a position in height of said guide shaft by abutting against said cam, wherein rotation of said cam changes the position in height of said guide shaft between a general print height and a CD print height, and wherein said guide shaft in the general print height abuts against said adjustment member so that the position in height of said guide shaft is regulated.

2. A recording apparatus according to claim 1, wherein the position in height of said guide shaft is set in accordance with information on the recording material in recording data.

3. A recording apparatus according to claim 1, wherein said adjustment member abuts against said guide shaft at a sloping portion of said adjustment member.

4. A recording apparatus according to claim 3, wherein said sloping of said adjustment member is slid relative to said chassis to adjust a position in height of the general print height of said guide shaft.

5. A recording apparatus according to claim 1, wherein said guide shaft abuts against a vertical surface provided on said chassis so that a position of said guide shaft in the recording material transporting direction is positioned regardless of change in the position in height of said guide shaft.

6. A recording apparatus according to claim 1, wherein said cam abuts against said carriage to regulate the position in height of said guide shaft to a cardboard print height.

* * * * *